US011543166B2

(12) United States Patent
Olvera et al.

(10) Patent No.: US 11,543,166 B2
(45) Date of Patent: Jan. 3, 2023

(54) ICE MAKER

(71) Applicant: Electrolux Home Products, Inc., Charlotte, NC (US)

(72) Inventors: Jose Carlos Trejo Olvera, Anderson, SC (US); Thomas W. McCollough, Anderson, SC (US); Matthias Bauer, Nabburg (DE); Georg Spiessl, Nabburg (DE)

(73) Assignee: Electrolux Home Products, Inc., Charlotte, NC (US)

( * ) Notice: Subject to any disclaimer, the term of this patent is extended or adjusted under 35 U.S.C. 154(b) by 262 days.

(21) Appl. No.: 16/836,007

(22) Filed: Mar. 31, 2020

(65) Prior Publication Data

US 2021/0302091 A1 Sep. 30, 2021

(51) Int. Cl.
*F25C 1/04* (2018.01)

(52) U.S. Cl.
CPC ..... *F25C 1/04* (2013.01); *F25C 2305/022* (2013.01); *F25C 2600/04* (2013.01); *F25C 2700/12* (2013.01)

(58) Field of Classification Search
CPC ..... F25C 5/187; F25C 1/24; F25C 2305/022; F25C 2500/02; F25C 2700/02; F25C 5/06; F25C 1/04; F25C 5/02; F25C 2305/0221
See application file for complete search history.

(56) References Cited

U.S. PATENT DOCUMENTS 2,717,497 A * 9/1955 Knerr ..... F25C 1/04 62/227
3,016,718 A * 1/1962 Malone ..... F25C 5/187 62/344
4,142,378 A * 3/1979 Bright ..... F25C 1/04 62/353
4,680,943 A 7/1987 Mawby
6,658,869 B1 12/2003 Thornbrough
7,665,316 B2 2/2010 Ito et al.
8,499,571 B2 8/2013 Saito
9,441,869 B2 9/2016 Stagg et al.
9,482,455 B2 11/2016 Hortin et al.
(Continued)

FOREIGN PATENT DOCUMENTS

JP 2019158283 9/2019
KR 20200120382 A * 4/2019 ..... F25C 1/00
WO WO-2014070512 A1 * 5/2014 ..... F25C 1/00

OTHER PUBLICATIONS

Translation of KR20200120382A entitled Translation—KR20200120382A (Year: 2020).*
(Continued)

*Primary Examiner* — Jenna M Hopkins
(74) *Attorney, Agent, or Firm* — Pearne & Gordon LLP

(57) ABSTRACT

An ice maker includes a carriage, an ice mold defining a plurality of cavities that is movably coupled to the carriage such that the ice mold is movable relative to the carriage between a home position and a harvest position, and a detection lever movably coupled to the carriage such that the detection lever is movable between a retracted position and an extended position, the detection member being biased toward the extended position. The ice maker further includes a retention mechanism configured to retain the detection lever in the retracted position when the ice mold is in the harvest position.

21 Claims, 18 Drawing Sheets

(56) References Cited

U.S. PATENT DOCUMENTS

| | | | | |
|---|---|---|---|---|
| 9,863,686 | B2 | 1/2018 | Park | |
| 9,976,788 | B2 * | 5/2018 | Bertolini | F25C 5/22 |
| 10,006,687 | B2 | 6/2018 | Stagg et al. | |
| 10,126,037 | B2 | 11/2018 | Barrena et al. | |
| 2005/0132739 | A1 | 6/2005 | Sammasi | |
| 2008/0072610 | A1 | 3/2008 | Venkatakrishnan | |
| 2012/0186288 | A1 | 7/2012 | Hapke | |
| 2020/0003470 | A1 * | 1/2020 | Ishimizu | F25C 1/10 |
| 2020/0124331 | A1 * | 4/2020 | Harata | F25C 1/04 |

OTHER PUBLICATIONS

International Search Report for PCT/US2021/024029, dated Jul. 2, 2021, 2 pages.

* cited by examiner

ICE MAKER

FIELD OF THE INVENTION

This application relates generally to a refrigeration appliance, and more particularly, an ice maker for a refrigeration appliance.

BACKGROUND OF THE INVENTION

Conventional refrigeration appliances, such as domestic refrigerators, typically have both a fresh food compartment and a freezer compartment or section. The fresh food compartment is where food items such as fruits, vegetables, and beverages are stored, and the freezer compartment is where food items that are to be kept in a frozen condition are stored. The refrigerators are provided with a refrigeration system that maintains the fresh food compartment at temperatures above 0° C. and the freezer compartments at temperatures below 0° C.

The arrangements of the fresh food and freezer compartments with respect to one another in such refrigerators vary. For example, in some cases, the freezer compartment is located above the fresh food compartment and in other cases the freezer compartment is located below the fresh food compartment. Additionally, many modern refrigerators have their freezer compartments and fresh food compartments arranged in a side-by-side relationship. Whatever arrangement of the freezer compartment and the fresh food compartment is employed, typically, separate access doors are provided for the compartments so that either compartment may be accessed without exposing the other compartment to the ambient air.

Such conventional refrigerators are often provided with a unit for making ice pieces, commonly referred to as "ice cubes" despite the non-cubical shape of many such ice pieces. These ice making units normally are located in the freezer compartments of the refrigerators and prepare ice by convection, i.e., by circulating cold air over water in an ice tray to freeze the water into ice cubes. Storage bins for storing the frozen ice pieces are also often provided adjacent to the ice making units. The ice pieces can be dispensed from the storage bins through a dispensing port in the door that closes the freezer to the ambient air. The dispensing of the ice usually occurs by means of an ice delivery mechanism that extends between the storage bin and the dispensing port in the freezer compartment door.

BRIEF SUMMARY OF THE INVENTION

The following presents a simplified summary of example embodiments of the invention. This summary is not intended to identify critical elements of the invention or to delineate the scope of the invention. The sole purpose of the summary is to present some example embodiments in simplified form as a prelude to the more detailed description that is presented later.

In accordance with a first aspect, an ice maker includes a carriage; an ice mold defining a plurality of cavities that is movably coupled to the carriage such that the ice mold is movable relative to the carriage between a home position and a harvest position; a detection lever movably coupled to the carriage such that the detection lever is movable between a retracted position and an extended position, the detection member being biased toward the extended position; and a retention mechanism configured to retain the detection lever in the retracted position when the ice mold is in the harvest position.

In one example of the first aspect, the retention mechanism includes a retention lever rotatably coupled to the carriage and an actuation member fixed to the ice mold that are configured to retain the detection lever in the retracted position when the ice mold is in the harvest position. In one example, the actuation member is configured to engage the retention lever as the ice mold is moved from the home position to the harvest position, causing the retention lever to rotate until the ice mold assumes the harvest position and the retention lever retains the detection lever in the retracted position.

In another example of the first aspect, the retention mechanism is configured to retain the detection lever in the retracted position when the ice mold is in the home position. In one example, the retention mechanism includes a retention arm fixed to the ice mold that is configured to retain the detection lever in the retracted position when the ice mold is in the home position. In another example, the retention arm is configured to engage the detection lever when the when the ice mold is in the home position and retain the detection lever in the retracted position, the retention arm is configured to disengage from the detection lever when the ice mold is moved from the home position to the harvest position, and the retention arm is configured to re-engage the detection lever when the ice mold is moved from the harvest position back to the home position.

In yet another example of the first aspect, the ice maker includes a spring configured to bias the detection lever towards the extended position.

In still yet another example of the first aspect, the ice maker includes a drive arm configured to exert force on the detection lever toward the extended position as the ice mold is moved from the home position to the harvest position if the detection lever remains in the retracted position upon release from the retention arm.

In another example of the first aspect, wherein the drive arm corresponds to the retention arm.

In accordance with a second aspect, an ice maker includes a carriage; an ice mold defining a plurality of cavities that is movably coupled to the carriage such that the ice mold is movable relative to the carriage between a home position and a harvest position; a detection lever movably coupled to the carriage such that the detection lever is movable between a retracted position and an extended position, the detection member being biased toward the extended position; and a self-contained control system including a controller and a non-contact sensor assembly configured to detect a predetermined position of the detection lever, the sensor assembly including a sensor and an actuation member configured to engage the sensor when the actuation member is within a predetermined region relative to the sensor.

In one example of the second aspect, the predetermined position of the detection lever corresponds to the extended position.

In another example of the second aspect, the sensor is a Hall Effect switch and the actuation member is a magnetic body configured to engage the hall effect switch when the magnetic body is within the predetermined region.

In yet another example of the second aspect, the sensor is fixed to the carriage and the actuation member is fixed to the detection lever such that the actuation member engages the sensor when the detection lever is in the extended position.

In accordance with a third aspect, an ice maker includes a carriage; an ice mold defining a plurality of cavities that is movably coupled to the carriage such that the ice mold is movable relative to the carriage between a home position and a harvest position; and a self-contained control system including: a controller, a temperature sensor fixed to the ice mold, and a wire coupled that electrically connects the temperature sensor to the controller, wherein the ice mold has a coupling element that rotatably couples the ice mold to the carriage, and the wire passes through a hole in the coupling element.

In one example of the third aspect, the drive assembly includes a drive shaft operatively coupled to the coupling element of the ice mold, and the wire passes through a hole in the drive shaft.

In accordance with a fourth aspect, an ice maker includes a carriage; an ice mold defining a plurality of cavities that is movably coupled to the carriage such that the ice mold is movable relative to the carriage between a home position and a harvest position; and a water slide for delivering water to the ice mold when in the home position, the water slide having a plurality of side walls and a floor that define a channel for water, wherein the ice maker defines a primary plane along which the plurality of cavities commonly open when the ice mold is in the home position, and the channel has a passage that curves about a slide axis that is substantially perpendicular to the primary plane.

In one example of the fourth aspect, the floor slopes in a downstream direction toward the primary plane.

In another example of the fourth aspect, the channel has an inlet and an outlet, and further includes an inlet passage that extends downstream from the inlet, an intermediate passage that downstream of the inlet passage, and an outlet passage downstream from the intermediate passage that terminates at the outlet. In one example, the outlet passage corresponds to the passage that curves about the slide axis. In another example, the inlet passage and the intermediate passage interest with each other to form a T-shape, and the intermediate passage is arranged substantially perpendicular to the inlet passage. In another example, the outlet passage is in-line with the intermediate passage.

In accordance with a fifth aspect, an ice maker includes a carriage; an ice mold defining a plurality of cavities that is movably coupled to the carriage such that the ice mold is movable relative to the carriage between a home position and a harvest position; and a first mounting element and a second mounting element for mounting the ice maker to an appliance, wherein the ice maker defines a primary plane along which the plurality of cavities commonly open when the ice mold is in the home position, the first mounting element and second mounting element respectively define a first mounting axis and a second mounting axis that are substantially parallel to the primary plane, and the first mounting axis and second mounting axis extend along a common mounting plane that is oblique to the primary plane.

In one example of the fifth aspect, the mounting plane forms an angle with the primary plane, the angle being between 1° and 5°.

In another example of the fifth aspect, the first mounting element corresponds to a first aperture defined by the carriage and the second mounting element corresponds to a second aperture defined by the carriage, wherein the first aperture extends farther from the primary plane than the second aperture.

In accordance with a sixth aspect, an ice maker includes a carriage; an ice mold defining a plurality of cavities that is movably coupled to the carriage such that the ice mold is movable relative to the carriage between a home position and a harvest position; a drive assembly that is operable to move the ice mold between the home position and the harvest position; a controller that is operatively coupled to the drive assembly and configured to perform an ice harvest operation that includes the step of moving the ice mold from the home position toward the harvest position; and a temperature sensor electrically coupled to the controller, wherein the controller is configured to perform a harvest initiation operation that includes: a monitoring step of monitoring a temperature detected by the temperature sensor, a first determining step of determining if a first harvest condition is satisfied during the monitoring step, wherein the first harvest condition requires that the temperature sensor detects a temperature equal to or below a first predetermined temperature and then a first predetermined amount of time elapses, a first initiation step of initiating the ice harvest operation if the first determining step determines that the first ice harvest condition is satisfied during the monitoring step, a second determining step of determining if a second harvest condition is satisfied during the monitoring step, wherein the second harvest condition requires that the temperature sensor detects a temperature equal to or below a second predetermined temperature and then a second predetermined amount of time elapses, and a second initiation step of initiating the ice harvest operation if the second determining step determines that the second ice harvest condition is satisfied during the monitoring step.

In one example of the sixth aspect, the first predetermined temperature is greater than the second predetermined temperature, and the first predetermined amount of time is greater than the second predetermined amount of time.

In accordance with a seventh aspect, an ice maker includes a carriage; an ice mold defining a plurality of cavities that is movably coupled to the carriage such that the ice mold is movable relative to the carriage between a home position and a harvest position; a detection lever movably coupled to the carriage such that the detection lever is movable between a retracted position and an extended position; a drive assembly that is operable to move the ice mold between the home position and the harvest position; a controller that is operatively coupled to the drive assembly; and a sensor assembly electrically coupled to the controller, wherein the sensor assembly is configured to detect a predetermined position of the detection lever and send an output to the controller indicating whether the detection lever is in the predetermined position. The controller is programmed to perform an ice harvest operation that includes: a monitoring step of monitoring the output of the sensor assembly, a determining step determining whether a detection lever condition is satisfied during the monitoring step, wherein the detection lever condition requires that the output of the sensor assembly indicates that the detection lever assumes the predetermined position, and at least one conditional step controlling movement of the ice mold based on the determining step.

In one example of the seventh aspect, the at least one conditional step includes a conditional step of moving the ice mold to the harvest position if the determining step determines that the detection lever condition is satisfied during the monitoring step. In one example, the ice harvest operation includes a returning step of moving the ice mold back to the home position in response to completion of the conditional step.

In another example of the seventh aspect, the at least one conditional step includes a conditional step of ceasing or desisting movement of the ice mold toward the harvest position if the determining step determines that the detection lever condition is never satisfied during the monitoring step. In one example, the ice harvest operation includes a moving step initiated before the determining step that includes moving the ice mold from the home position toward the harvest position. In another example, the ice harvest operation includes a returning step of moving the ice mold back to the home position in response to completion of the conditional step.

In yet another example of the seventh aspect, the ice harvest operation includes a restarting step of restarting the ice harvest operation after completion of the second conditional step.

In still yet another example of the seventh aspect, the ice harvest operation includes a moving step initiated before the determining step that includes moving the ice mold from the home position toward the harvest position, the at least one conditional step includes a first conditional step of moving the ice mold to the harvest position if the determining step determines that the detection lever condition is satisfied during the monitoring step, and the at least one conditional step includes a second conditional step of ceasing movement of the ice mold toward the harvest position if the determining step determines that the detection lever condition is never satisfied during the monitoring step. In one example, the ice harvest operation includes: a first returning step of moving the ice mold back to the home position in response to completion of the first conditional step, and a second returning step of moving the ice mold back to the home position in response to completion of the second conditional step. In another example, the ice harvest operation includes a restarting step of restarting the ice harvest operation after completion of the second conditional step.

In another example of the seventh aspect, the predetermined position of the detection lever corresponds to the extended position.

In accordance with an eighth aspect, an ice maker includes a carriage; an ice mold defining a plurality of cavities that is movably coupled to the carriage such that the ice mold is movable relative to the carriage between a home position and a harvest position; a controller; and an indicator that is electrically coupled to the controller and operable to provide an indication, wherein the controller is programmed to perform a diagnostic operation that includes: a monitoring step of monitoring one or more parameters of the ice maker, a determining step of determining if a diagnostic condition is satisfied during the monitoring step, and an indicating step of operating the indicator based on the determining step.

In one example of the eighth aspect, the ice maker includes a control line electrically coupled to the controller, the monitoring step includes monitoring a rate of power drawn through the control line while a positive voltage is applied to the control line by the controller, the diagnostic condition of the determining step requires that a rate of power realized during the monitoring step is within a predetermined range of power, and the indicating step operates the indicator to provide an indication if the determining step determines that the diagnostic condition is never satisfied during the monitoring step.

In another example of the eighth aspect, the ice maker includes a temperature sensor electrically coupled to the controller, the monitoring step includes monitoring temperature detected by the temperature sensor, the diagnostic condition of the determining step requires that the temperature sensor detects a temperature during the monitoring step that is within a predetermined range of temperatures, and the indicating step operates the indicator to provide an indication if the determining step determines that the diagnostic condition is never satisfied during the monitoring step.

In yet another example of the eighth aspect, the ice maker includes a detection lever movably coupled to the carriage such that the detection lever is movable between a retracted position and an extended position, the ice maker includes a sensor assembly electrically coupled to the controller, wherein the sensor assembly is configured to detect a predetermined position of the detection lever and provide an output to the controller indicating whether the detection lever is in the predetermined position, the monitoring step includes monitoring the output of the sensor assembly, the diagnostic condition of the determining step requires that the output monitored during the monitoring step indicates that the detection lever never assumes the predetermined position during the monitoring step, and the indicating step operates the indicator to provide an indication if the determining step determines that the diagnostic condition is not satisfied during the monitoring step. In one example, the predetermined position corresponds to the extended position.

In still yet another example of the eighth aspect, the ice maker includes a detection lever movably coupled to the carriage such that the detection lever is movable between a retracted position and an extended position, the ice maker includes a sensor assembly electrically coupled to the controller, wherein the sensor assembly is configured to detect a predetermined position of the detection lever and provide an output to the controller indicating whether the detection lever is in the predetermined position, the monitoring step includes monitoring the output of the sensor assembly, the diagnostic condition of the determining step requires that the output monitored during the monitoring step indicates that the detection lever assumes the predetermined position during the monitoring step, and the indicating step operates the indicator to provide an indication if the determining step determines that the diagnostic condition is never satisfied during the monitoring step. In one example, the predetermined position corresponds to the extended position.

In another example of the eighth aspect, the ice maker includes a drive assembly that is operable to move the ice mold between the home position and the harvest position, the controller being operatively coupled to the drive assembly, the ice maker includes a sensor assembly electrically coupled to the controller, wherein the sensor assembly is configured to detect a position of the ice mold and provide an output to the controller indicating the position of the ice mold, the diagnostic operation includes performing an ice harvest operation that moves the ice mold from the home position to the harvest position, the monitoring step includes monitoring the output of the sensor assembly during the ice harvest operation, the diagnostic condition of the determining step requires that the ice mold moves from the home position to the harvest position before a predetermined time, and the indicating step operates the indicator to provide an indication if the determining step determines that the diagnostic condition is never satisfied during the monitoring step.

In accordance with a ninth aspect, an ice maker includes a carriage; an ice mold defining a plurality of cavities that is movably coupled to the carriage such that the ice mold is movable relative to the carriage between a home position and a harvest position; and a drive assembly that is operable to move the ice mold between the home position and the harvest position, the drive assembly including a motor and transmission that operatively couples the motor to the ice mold, wherein the ice mold is rotatably coupled to the carriage such that the ice mold is rotatable about an axis, the ice mold has a first portion and a second portion axially spaced from each other along the axis and configured to rotate about the axis as the ice mold moves from the home position to the harvest position, the first portion rotates a first angular distance about the axis when the ice mold moves from the home position to the harvest position, and the second portion rotates a second angular distance about the axis when the ice mold moves from the home position to the harvest position, the second angular distance being different than the first angular distance.

In one example of the ninth aspect, the carriage includes a stopper member configured to engage the second portion as the ice mold moves from the home position to the harvest position and inhibit rotation of the second portion beyond the second angular distance.

In accordance with a tenth aspect, an ice maker includes a carriage, an ice mold movably coupled to the carriage such that the ice mold is movable relative to the carriage between a home position and a harvest position, and a temperature sensor. A method of operating the ice maker include a harvest initiation operation that includes: a monitoring step of monitoring a temperature detected by the temperature sensor; a first determining step of determining if a first harvest condition is satisfied during the monitoring step, wherein the first harvest condition requires that the temperature sensor detects a temperature equal to or below a first predetermined temperature and then a first predetermined amount of time elapses; a first initiation step of initiating an ice harvest operation if the first determining step determines that the first ice harvest condition is satisfied during the monitoring step; a second determining step of determining if a second harvest condition is satisfied during the monitoring step, wherein the second harvest condition requires that the temperature sensor detects a temperature equal to or below a second predetermined temperature and then a second predetermined amount of time elapses; and a second initiation step of initiating the ice harvest operation if the second determining step determines that the second ice harvest condition is satisfied during the monitoring step, wherein the ice harvest operation moves the ice mold from the home position toward the harvest position.

In one example of the tenth aspect, first predetermined temperature is greater than the second predetermined temperature, and the first predetermined amount of time is greater than the second predetermined amount of time.

In accordance with an eleventh aspect, an ice maker includes a carriage, an ice mold movably coupled to the carriage such that the ice mold is movable relative to the carriage between a home position and a harvest position, a detection lever movably coupled to the carriage such that the detection lever is movable between a retracted position and an extended position, and a sensor assembly configured to detect a predetermined position of the detection lever and provide an output indicating whether the detection lever is in the predetermined position. A method of operating the ice maker includes a monitoring step of monitoring the output of the sensor assembly; a determining step determining whether a detection lever condition is satisfied during the monitoring step, wherein the detection lever condition requires that the output of the sensor assembly indicates that the detection lever assumes the predetermined position; and at least one conditional step controlling movement of the ice mold based on the determining step.

In one example of the eleventh aspect, the at least one conditional step includes a conditional step of moving the ice mold to the harvest position if the determining step determines that the detection lever condition is satisfied during the monitoring step. In one example, the ice harvest operation includes a returning step of moving the ice mold back to the home position in response to completion of the conditional step.

In another example of the eleventh aspect, the at least one conditional step includes a conditional step of ceasing or desisting movement of the ice mold toward the harvest position if the determining step determines that the detection lever condition is never satisfied during the monitoring step. In one example, the ice harvest operation includes a moving step initiated before the determining step that includes moving the ice mold from the home position toward the harvest position. In one example, the ice harvest operation includes a returning step of moving the ice mold back to the home position in response to completion of the conditional step. In one example, the ice harvest operation includes a restarting step of restarting the ice harvest operation after completion of the second conditional step.

In yet another example of the eleventh aspect, the ice harvest operation includes a moving step initiated before the determining step that includes moving the ice mold from the home position toward the harvest position, the at least one conditional step includes a first conditional step of moving the ice mold to the harvest position if the determining step determines that the detection lever condition is satisfied during the monitoring step, and the at least one conditional step includes a second conditional step of ceasing movement of the ice mold toward the harvest position if the determining step determines that the detection lever condition is never satisfied during the monitoring step. In one example, the ice harvest operation includes: a first returning step of moving the ice mold back to the home position in response to completion of the first conditional step, and a second returning step of moving the ice mold back to the home position in response to completion of the second conditional step. In one example, the ice harvest operation includes a restarting step of restarting the ice harvest operation after completion of the second conditional step.

In still yet another example of the eleventh aspect, the predetermined position of the detection lever corresponds to the extended position.

In accordance with a twelfth aspect, an ice maker includes a carriage, an ice mold movably coupled to the carriage such that the ice mold is movable relative to the carriage between a home position and a harvest position, and an indicator. A method of operating the ice maker includes a monitoring step of monitoring one or more parameters of the ice maker; a determining step of determining if a diagnostic condition is satisfied during the monitoring step; and an indicating step of operating the indicator based on the determining step.

In one example of the twelfth aspect, the ice maker includes a control line, the monitoring step includes monitoring a rate of power drawn through the control line while a positive voltage is applied to the control line, the diagnostic condition of the determining step requires that a rate of power realized during the monitoring step is within a predetermined range of power, and the indicating step operates the indicator to provide an indication if the determining step determines that the diagnostic condition is never satisfied during the monitoring step.

In another example of the twelfth aspect, the ice maker includes a temperature sensor, the monitoring step includes monitoring temperature detected by the temperature sensor, the diagnostic condition of the determining step requires that the temperature sensor detects a temperature during the monitoring step that is within a predetermined range of temperatures, and the indicating step operates the indicator to provide an indication if the determining step determines that the diagnostic condition is never satisfied during the monitoring step.

In yet another example of the twelfth aspect, the ice maker includes a detection lever movably coupled to the carriage such that the detection lever is movable between a retracted position and an extended position, the ice maker includes a sensor assembly, wherein the sensor assembly is configured to detect a predetermined position of the detection lever and provide an output indicating whether the detection lever is in the predetermined position, the monitoring step includes monitoring the output of the sensor assembly, the diagnostic condition of the determining step requires that the output monitored during the monitoring step indicates that the detection lever never assumes the predetermined position during the monitoring step, and the indicating step operates the indicator to provide an indication if the determining step determines that the diagnostic condition is not satisfied during the monitoring step. In one example, the predetermined position corresponds to the extended position.

In still yet another example of the twelfth aspect, the ice maker includes a detection lever movably coupled to the carriage such that the detection lever is movable between a retracted position and an extended position, the ice maker includes a sensor assembly, wherein the sensor assembly is configured to detect a predetermined position of the detection lever and provide an output indicating whether the detection lever is in the predetermined position, the monitoring step includes monitoring the output of the sensor assembly, the diagnostic condition of the determining step requires that the output monitored during the monitoring step indicates that the detection lever assumes the predetermined position during the monitoring step, and the indicating step operates the indicator to provide an indication if the determining step determines that the diagnostic condition is never satisfied during the monitoring step. In one example, the predetermined position corresponds to the extended position.

In another example of the twelfth aspect, the ice maker includes a sensor assembly configured to detect a position of the ice mold and provide an output indicating the position of the ice mold, the diagnostic operation includes performing an ice harvest operation that moves the ice mold from the home position to the harvest position, the monitoring step includes monitoring the output of the sensor assembly during the ice harvest operation, the diagnostic condition of the determining step requires that the ice mold moves from the home position to the harvest position before a predetermined time, and the indicating step operates the indicator to provide an indication if the determining step determines that the diagnostic condition is never satisfied during the monitoring step.

It is to be understood that both the foregoing general description and the following detailed description present example and explanatory embodiments. The accompanying drawings are included to provide a further understanding of the described embodiments and are incorporated into and constitute a part of this specification. The drawings illustrate various example embodiments.

BRIEF DESCRIPTION OF THE DRAWINGS

The foregoing and other aspects of the present invention will become apparent to those skilled in the art to which the present invention relates upon reading the following description with reference to the accompanying drawings, in which.

DETAILED DESCRIPTION

Figure 1:
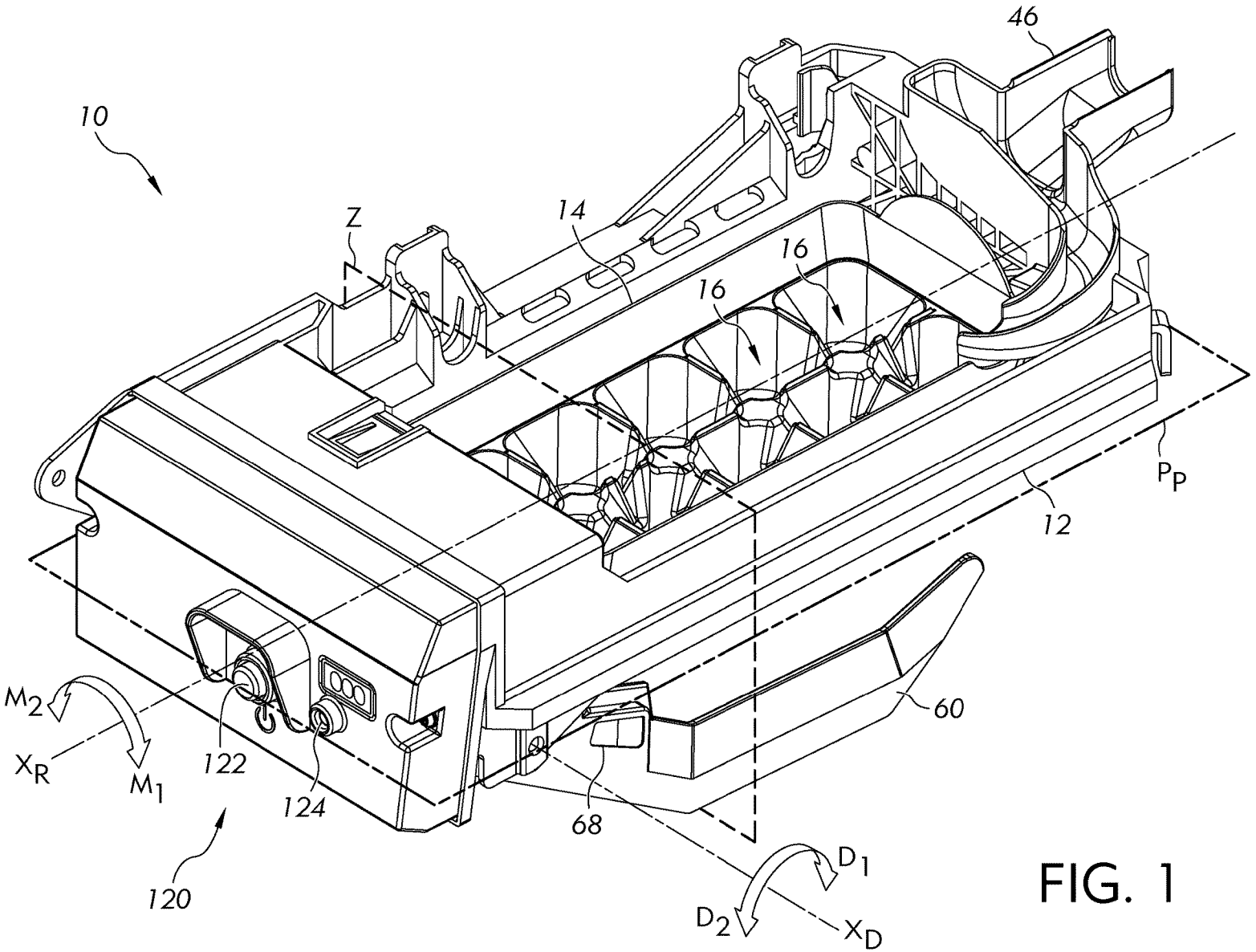
FIG. 1 is a front-perspective view of an example ice maker.

Example embodiments are described and illustrated in the drawings. These illustrated examples are not intended to be a limitation on the present invention. For example, one or more aspects can be utilized in other embodiments and even other types of devices. Moreover, certain terminology is used herein for convenience only and is not to be taken as a limitation. Still further, in the drawings, the same reference numerals are employed for designating the same elements.

FIGS. 1-4 illustrate an ice maker 10 for an appliance (e.g., refrigerator), which includes a carriage 12 and an ice mold 14 movably coupled to the carriage 12. The ice mold 14 defines a plurality of cavities 16 such that water can be poured into the cavities 16 and then frozen to form ice. The number and shape of the cavities 16 can vary by embodiment. Moreover, in some examples the ice maker 10 can include a cover (not shown) that is coupled to the carriage 12 and covers the cavities 16 of the ice mold 14.

I. Movement of Ice Mold

The ice mold 14 is movably coupled to the carriage 12 such that the ice mold 14 is movable relative to the carriage 12 between a plurality of positions. For example, the ice mold 14 in the illustrated embodiment has two end portions 18*a*, 18*b* and two coupling elements 20*a*, 20*b* that project respectively from the end portions 18*a*, 18*b* and define a rotational axis $X_R$ of the ice mold 14. The coupling elements 20*a*, 20*b* of the ice mold 14 are inserted into corresponding openings 22*a*, 22*b* defined by the carriage 12 such that the ice mold 14 is supported at both end portions 18*a*, 18*b* by the carriage 12 and rotatable about the axis $X_R$.

Figure 4:
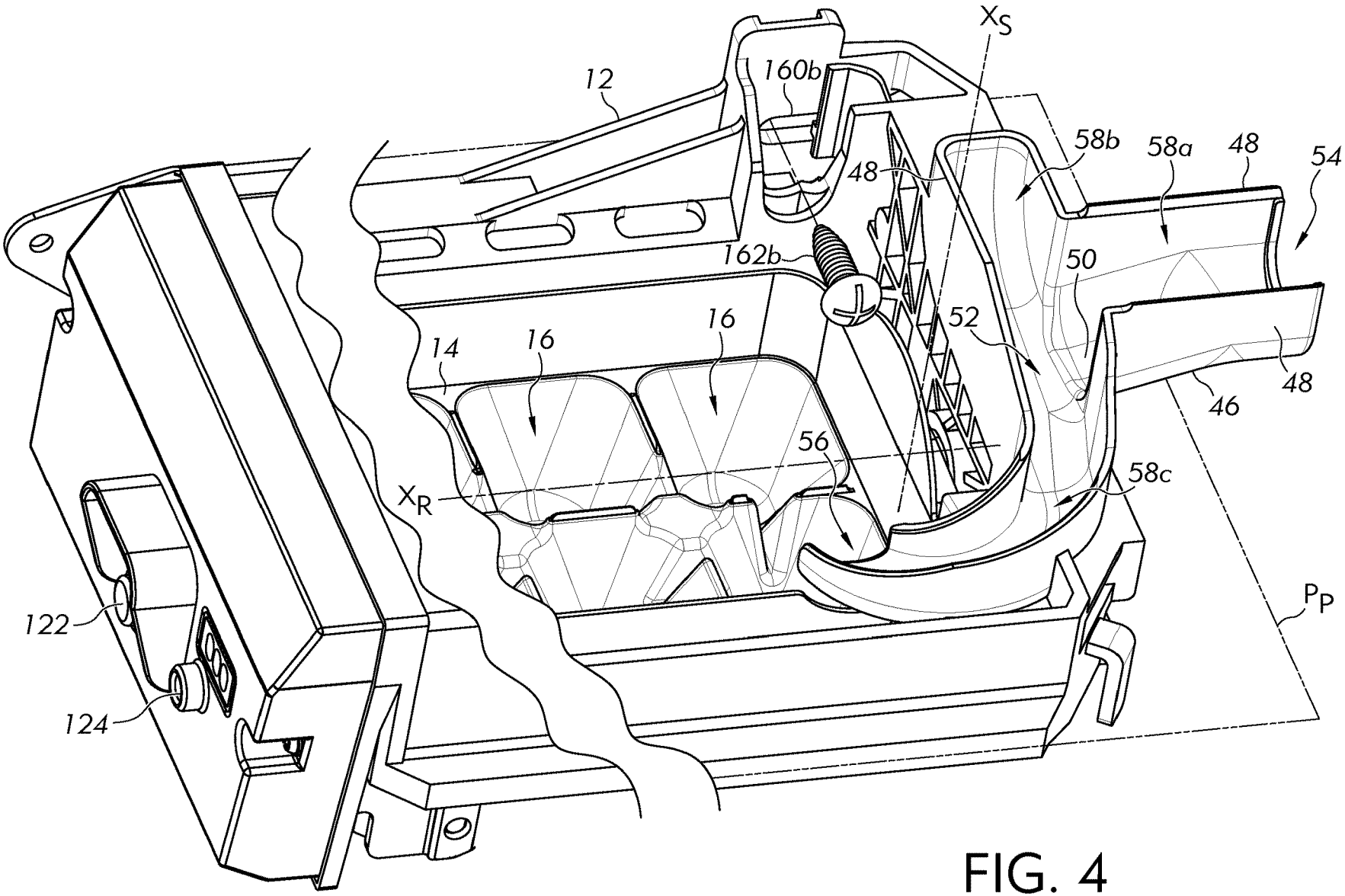
FIG. 4 is an enlarged perspective view of a water slide of the ice maker.

The ice mold 14 in FIGS. 1 & 4 is shown in a "home position", which corresponds to a position in which ice will be formed in the ice mold 14. The ice mold 14 can be rotated about the axis $X_R$ in a first direction $M_1$ to a "harvest position", which corresponds to a position in which ice will be harvested from the ice mold. The ice mold 14 can then be rotated about the axis $X_R$ in an opposite direction $M_2$ back to the home position for making more ice.

The degree to which the ice mold 14 rotates about the axis $X_R$ from its home position to the harvest position can vary in embodiments, although preferably the ice mold 14 will rotate at least 90°, and more preferably at least 120°, to ensure that frozen ice will fall from the cavities 16 when the ice mold 14 is rotated to the harvest position. Moreover, the ice mold 14 may be rotatable about other axes or movable in other manners (e.g., tilting, sliding, etc.) between its home and harvest positions. Still further, the home position and/or harvest position may be positioned differently than as described and illustrated herein. Broadly speaking, the home and harvest positions can be any two different positions relative to the carriage 12, and the ice mold 14 can be movable in a variety of different manners between the two positions.

Figure 5:
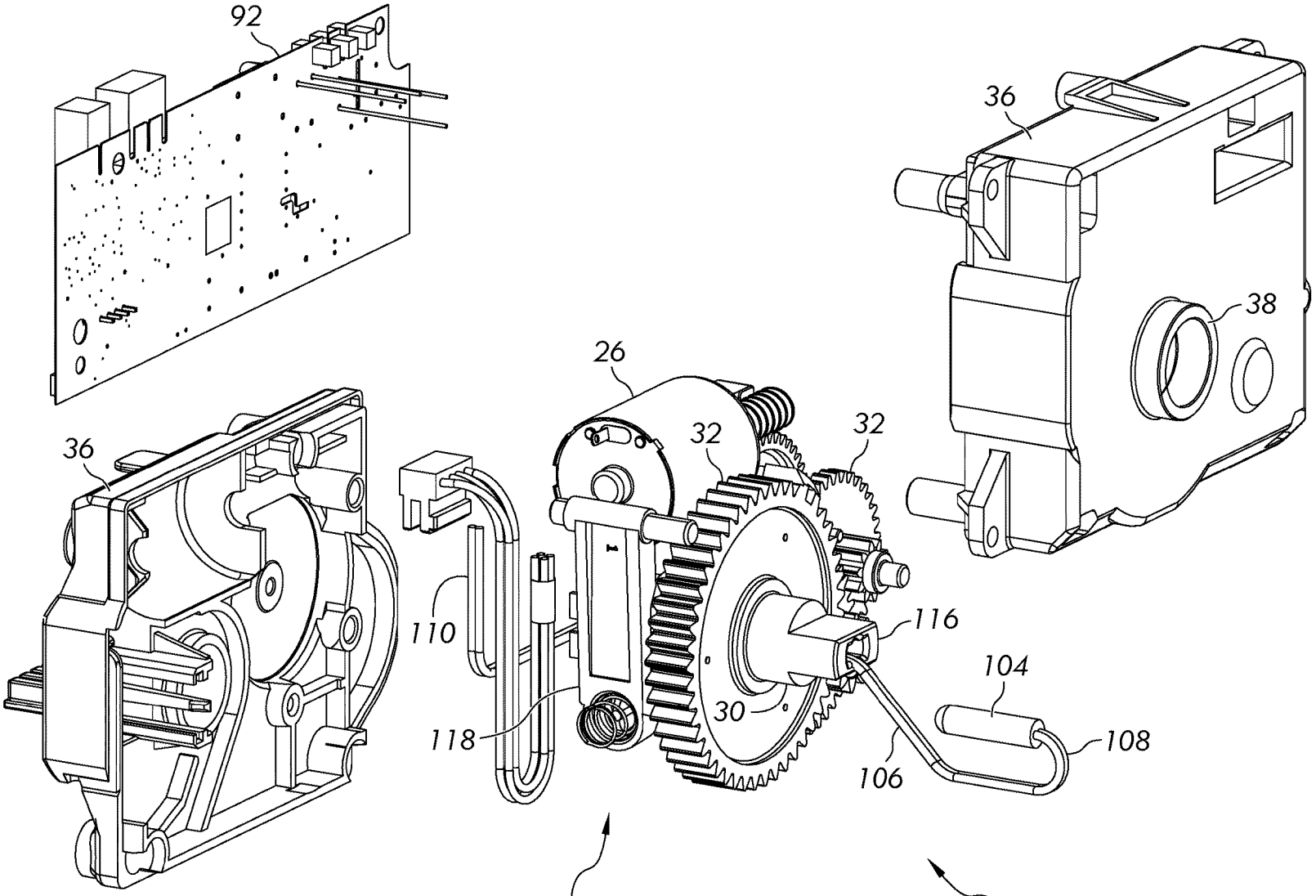
FIG. 5 is an exploded view of a drive assembly and various control elements of the ice maker.

The ice maker 10 can include a drive assembly 24 that is operable to move the ice mold 14 between its home and harvest positions. As shown in FIG. 5, the drive assembly 24 in the present embodiment includes a motor 26 (e.g., DC motor) and a transmission 28 that operatively couples the motor 26 to the ice mold 14. The transmission 28 has a drive shaft 30 with a non-circular (e.g., square or rectangular) cross-section, and one or more gears 32 that operatively couple the motor 26 to the drive shaft 30. The drive assembly 24 further includes a housing 36 that encloses and supports the motor 26 and gears 32, and defines an opening 38 through which the drive shaft 30 penetrates. The housing 36 is fixed to the carriage 12 such that the drive shaft 30 passes through the opening 22*a* of the carriage 12 and extends into a mating hole 42 defined by the coupling element 20*a* of the ice mold 14 (see FIG. 3), thereby operatively coupling the ice mold 14 to the drive shaft 30. In this manner, the motor 26 can be operated to rotate the drive shaft 30 via the gears 32 and rotate the ice mold 14 accordingly.

However, it is to be appreciated that the drive assembly 24 can comprise a variety of additional and/or alternative features and configurations for moving the ice mold 14 between its home and harvest positions. For instance, the drive assembly 24 in some embodiments may simply comprise a motor that is directly coupled to the ice mold 14. The drive assembly 24 can comprise any configuration of one or more mechanical and/or electro-mechanical elements that is operable to move the ice mold 14 between its home and harvest positions.

In some examples, the ice maker 10 can be configured such that the ice mold 14 will twist as it moves from its home position to the harvest position in order to facilitate the ejection of ice from the ice mold 14 in its harvest position. For example, as discussed above, the ice mold 14 in the present embodiment is rotatably supported at both end portions 18*a*, 18*b* by the carriage 12, and is operatively coupled at the first end portion 18*a* to the drive shaft 30 of the drive assembly 24. The motor 26 of the drive assembly 24 can be operated to rotate the carriage 12 about the axis $X_R$ from its home position to the harvest position. In particular, the motor 26 can be operated to rotate the first end portion 18*a* of the ice mold 14 a first angular distance about the axis $X_R$ (e.g., preferably at least 90°, and more preferably at least 120°).

As the ice mold 14 initially rotates from its home position toward the harvest position, both end portions 18*a*, 18*b* will rotate together about the axis $X_R$. However, the carriage 12 in the illustrated embodiment includes a stopper member 44 (see FIG. 3) that will eventually engage (e.g., contact) the second end portion 18*b* as the ice mold 14 moves and inhibit further rotation of the second end portion 18*b* beyond a certain angular distance. Thus, the second end portion 18*b* will cease rotating while the first end portion 18*a* continues to rotate until the ice mold 14 assumes the harvest position. As such, the first and second end portions 18*a*, 18*b* of the ice mold 14 (which are axially spaced from each other along the axis $X_R$) will rotate different angular distances when the ice mold 14 moves from its home position to the harvest position, causing the ice mold 14 to twist between its first and second end portions 18*a*, 18*b*. That is, the first end portion 18*a* will rotate a first angular distance and the second end portion 18*b* will rotate a second angular distance that is less than the first angular distance.

Preferably, the difference in angular distance of travel for the first and second end portions 18*a*, 18*b* between the home and harvest positions will be between 20° and 50°, and more preferably between 30° and 40°, and still more preferably about 35°. However, other differentials may be possible in other embodiments. Moreover, the first and second end portions 18*a*, 18*b* may travel the same angular distance in some embodiments such that the ice mold 14 does not twist at all when moved between its home and harvest positions.

As the ice mold 14 in its twisted state rotates from the harvest position back toward the home position, the first end portion 18*a* will initially rotate while the second end portion 18*b* remains stationary. The first end portion 18*a* will rotate until the ice mold 14 returns to its non-twisted state, at which point both end portions 18*a*, 18*b* will then rotate together about the axis $X_R$ until the ice mold 14 assumes the home position. However, in examples wherein the ice mold 14 is stuck in its twisted state as it leaves the home position and returns the home position, the second end portion 18*b* can be configured to engage the stopper member 44 of the carriage 12 as the ice mold 14 enters the home position such that the second end portion 18*b* stops rotating while the first end portion 18*a* continues to rotate, thereby forcing the ice mold 14 back to its non-twisted state.

II. Water Slide

As shown best in FIG. 4, the ice maker 10 can include a water slide 46 for delivering water to the ice mold 14 while in the home position. The water slide 46 includes a plurality of side walls 48 and a floor 50 that collectively define a channel 52 for water. The channel 52 has an inlet 54 and an outlet 56, wherein flow through the channel 52 towards the outlet 56 defines the downstream direction of the channel 52. Moreover, the channel 52 has an inlet passage 58*a* that extends downstream from the inlet 54, an intermediate passage 58*b* downstream of the inlet passage 58*a*, and an outlet passage 58*c* downstream of the intermediate passage 58*b* that terminates at the outlet 56.

The floor 50 of the channel 52 slopes in the downstream direction toward a primary plane $P_p$ of the ice maker 10, the primary plane $P_p$ being a plane along which the cavities 16 of the ice mold 14 commonly open when the ice mold 14 is in its home position. More specifically, the floor 50 along each passage 58 of the channel 52 slopes in the downstream direction such that an upstream end of the passage's floor is farther from the primary plane $P_p$ than a downstream end of the passage's floor.

The inlet passage 58*a* and intermediate passage 58*b* of the channel 52 intersect with each other to form a T-shape. In particular, the intermediate passage 58*b* is arranged substantially perpendicular to the inlet passage 58*a* (e.g., within 20° of perpendicular to the inlet passage 58*a*) such that water can be fed through the inlet passage 58*a* into the intermediate passage 58*b* and then redirected by the intermediate passage 58*b* in a substantially perpendicular direction. Meanwhile, the outlet passage 58*c* is in line with the intermediate passage 58*b* and curves about a slide axis $X_S$ that is substantially perpendicular to the primary plane $P_p$ (e.g., within 20° of perpendicular to the primary plane $P_p$).

The spatial relationships described above can help introduce a smooth flow of water through the outlet 56 of the water slide 46 into the cavities 16 of the ice mold 14. However, it is to be appreciated that the water slide 46 may comprise other configurations in other embodiments. Moreover, the ice maker 10 may exclude the water slide 46 in some examples, as water can be fed directly into the cavities 16 of the ice mold 14 by an external water line of an appliance in which the ice maker 10 is installed.

III. Detection Lever

Figure 2:
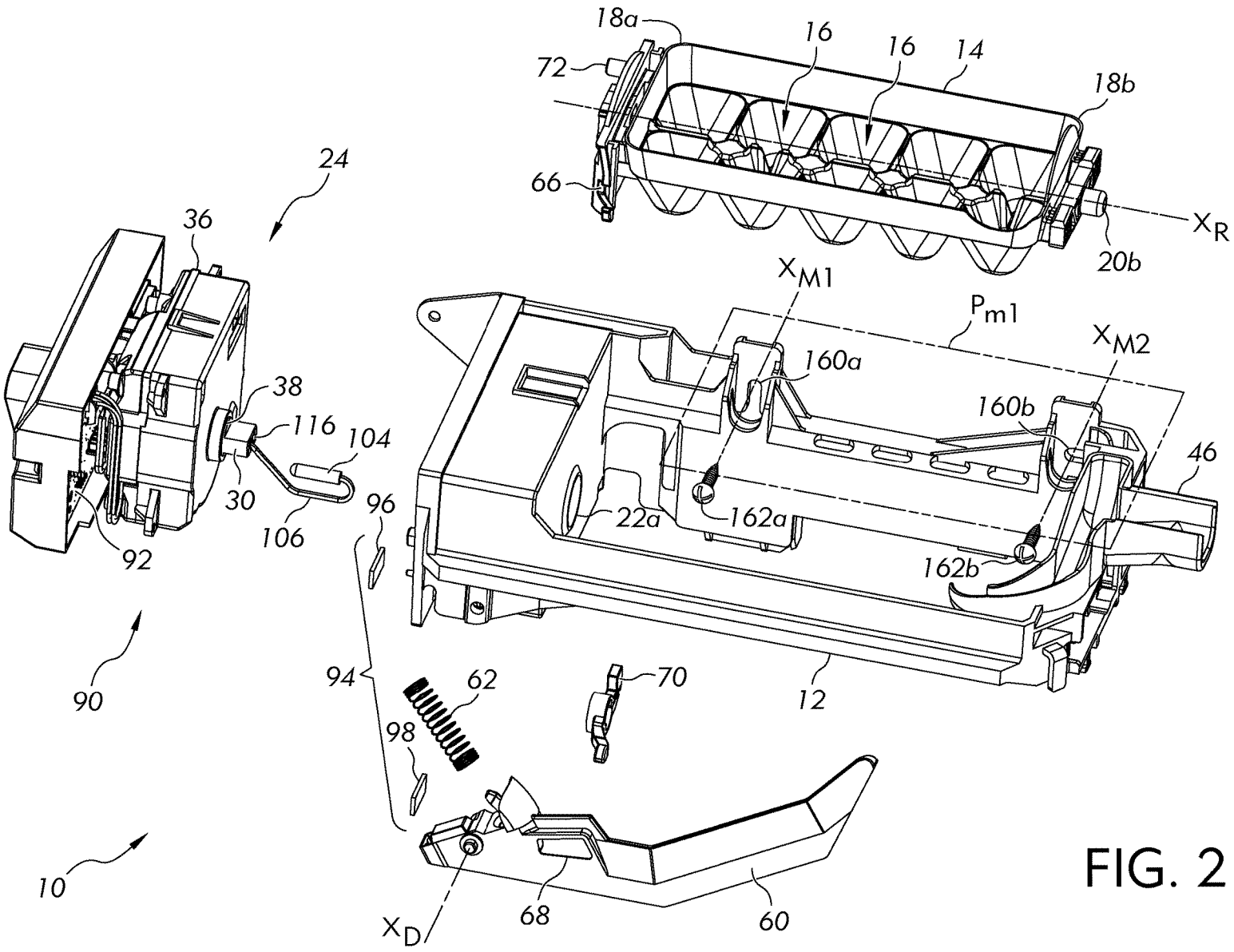
FIG. 2 is a first exploded view of the ice maker.
Figure 3:
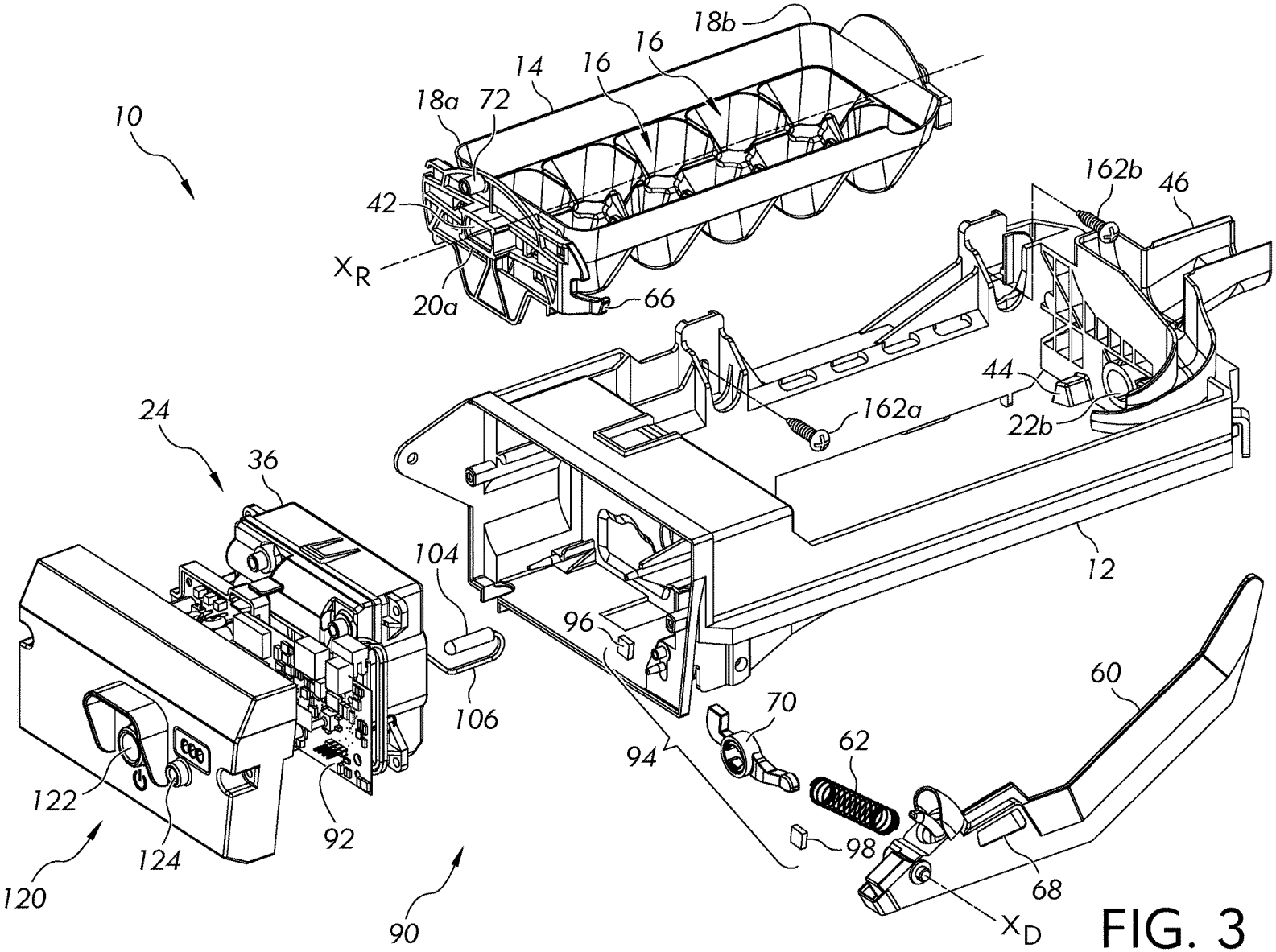
FIG. 3 is a second exploded view of the ice maker.

As shown in FIGS. 1-3, the ice maker 10 can include a detection lever 60 that is movably coupled to the carriage 12 and can indicate the presence or absence of ice previously harvested from the ice maker 10, which in turn can be useful for determining whether additional ice should be made and harvested. This can be referred to as a "bale arm" or "ice level arm." For example, the detection lever 60 in the present embodiment is pivotally mounted to the carriage 12 such that the detection lever 60 can be rotated about an axis XD between a retracted position and an extended position. The detection lever 60 is shown in FIG. 1 in the retracted position, and the extended position is assumed by rotating the detection lever 60 from the retracted position in a first direction $D_1$ a predetermined angular distance that is between 25° and 45°, and more preferably between 30° and 40°, and still more preferably about 35°. However, other angular distances are possible in other embodiments.

The detection lever 60 can be biased toward the extended position by a variety of different means. For example, the detection lever 60 can be biased by gravity toward the extended position, and/or the ice maker 10 can include a spring 62 (see FIGS. 2 & 3) that is configured to bias the detection lever 60 toward the extended position. In particular, the spring 62 can be configured such that the spring 62 is compressed when the detection lever 60 assumes the retracted position and pushes the detection lever 60 toward the extended position. Alternatively, the spring 62 can be configured such that the spring 62 is tensioned when the detection lever 60 assumes the retracted position and pulls the detection lever 60 toward the extended position.

In the illustrated embodiment, the spring 62 is arranged between the carriage 12 and detection lever 60 such that the carriage 12 and detection lever 60 compress the spring 62 when the detection lever 60 assumes the retracted position. Preferably, the spring 62 will be attached at one or both of its ends to the carriage 12 and/or detection lever 60 to prevent the spring 62 from coming loose and falling out of place.

When the carriage 12 of the ice maker 10 is mounted in an appliance, a receptacle can be arranged below the ice mold 14 for collecting ice harvested from the ice mold 14. As the ice collects and fills the receptacle, the buildup of ice can physically impede the detection lever 60 from assuming its extended position, causing the detection lever 60 to remain in its retracted position or some other position intermediate the retracted and extended positions. Thus, the retracted and intermediate positions of the detection lever 60 can indicate a state in which a sufficient amount of ice is stored in the bin and no further ice needs to be made and harvested. Conversely, the extended position of the detection lever 60 can indicate a state in which little or no ice is stored in the bin and more ice should be made and harvested.

It is to be appreciated that the detection lever 60 can be movably coupled to the carriage 12 in a variety of different manners such that the detection lever 60 is indicative of the presence or absence of ice previously harvested. For example, the detection lever 60 may be rotatable about other axes, or may be translatable in a linear direction (e.g., up/down) between its retracted and extended positions. Moreover, the detection lever 60 can comprise alternative shapes and sizes than that illustrated. The detection lever 60 can take on any form that is movable between retracted and extended positions, the positions being indicative of the presence or absence of ice previously harvested.

Figure 6:
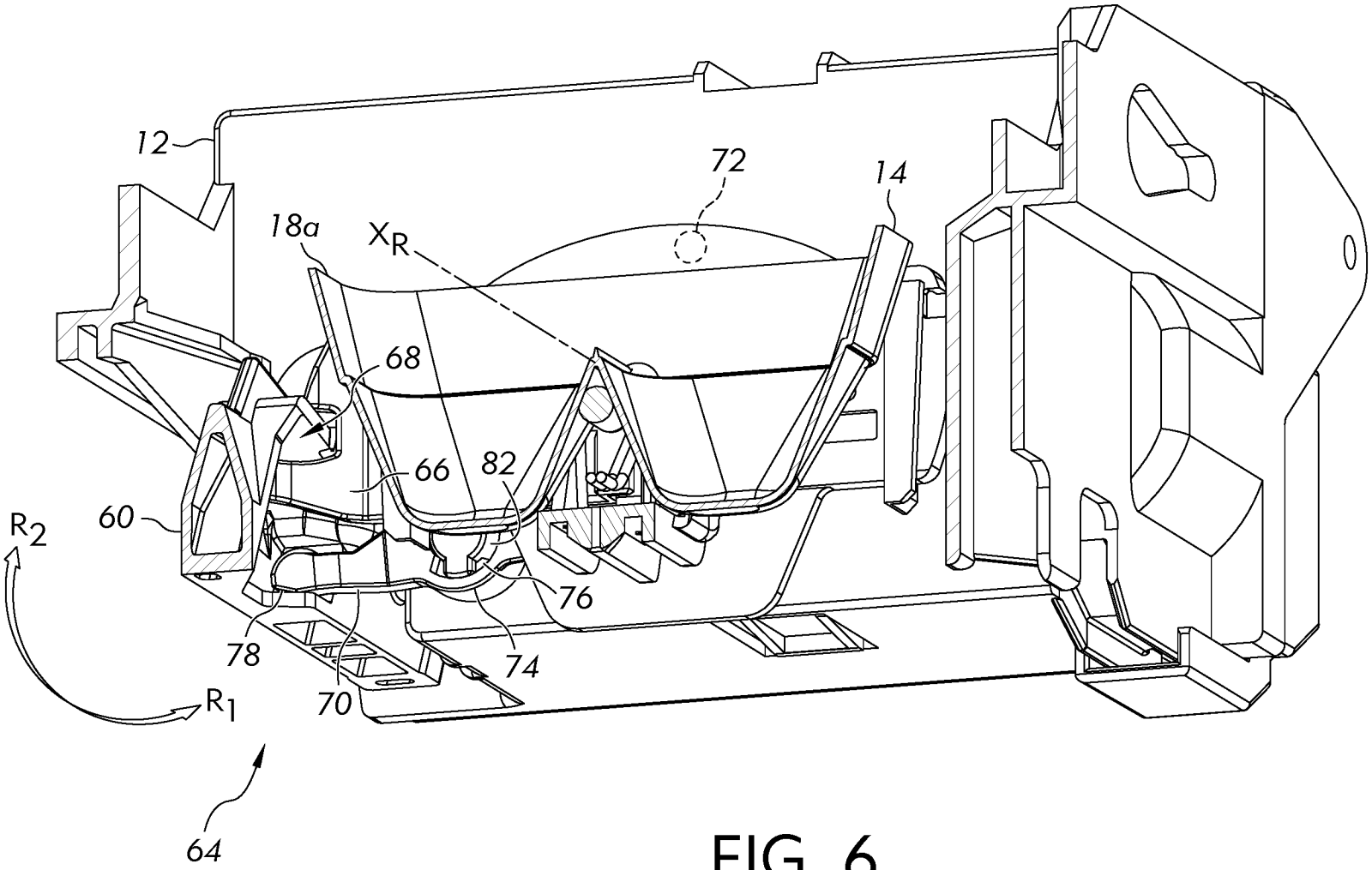
FIG. 6 is a cross-section view of the ice maker taken along plane Z in FIG. 1.

As noted above, the detection lever 60 can be biased towards its extended position. However, the extended position of the detection lever 60 may interfere with the ejection of ice from the ice mold 14 when the ice mold 14 is rotated to its harvest position. Moreover, the extended position of the detection lever 60 may interfere with user access to ice stored in a bin below the ice maker 10. Accordingly, the ice maker 10 can include a retention mechanism 64 (see FIGS. 6 & 7) that is configured to normally retain the detection lever 60 in its retracted position, as described below.

IV. Retention Mechanism

The retention mechanism 64 in the illustrated embodiment includes a retention arm 66 that is configured to retain the detection lever 60 in its retracted position whenever the ice mold 14 is in its home position. In particular, the retention arm 66 is fixed to (e.g., integral formed with) the ice mold 14 and configured to engage (e.g., contact and hook) the detection lever 60 when the ice mold 14 is in its home position (see FIG. 6), thereby retaining the detection lever 60 in its retracted position. The retention arm 66 can engage the detection lever 60 by extending through or into an aperture 68 in the detection lever 60 such that the retention arm 66 contacts and hooks an upper edge of the aperture 68, although the retention arm 66 can engage other portions of the detection lever 60 in other examples.

Figure 7:
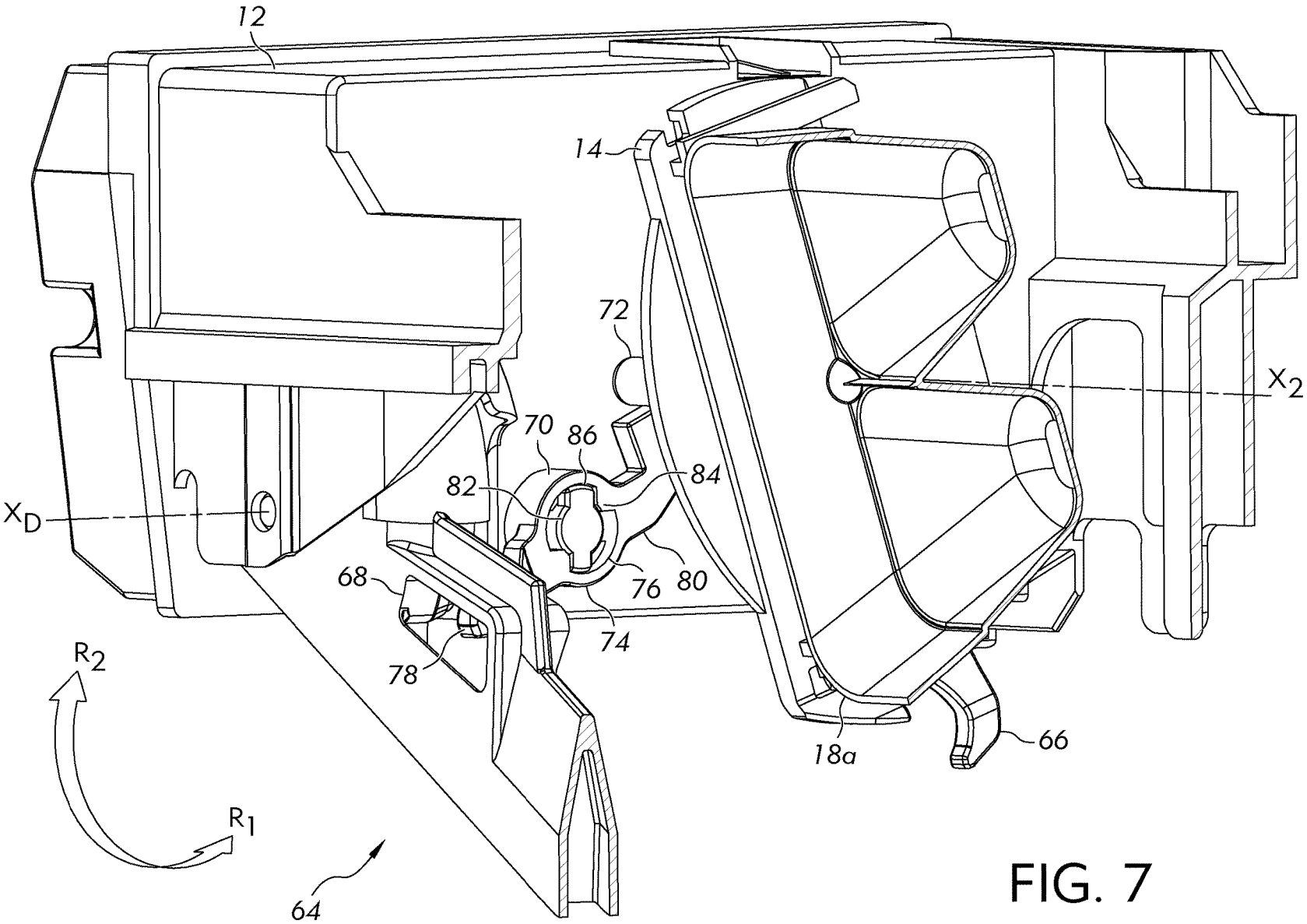
FIG. 7 is another cross-section view of the ice maker taken along plane Z in FIG. 1, wherein an ice mold of the ice maker has been moved to a harvest position.

As the ice mold 14 is rotated from its home position to its harvest position, the retention arm 66 will rotate with the ice mold 14 and disengage from the detection lever 60, releasing the detection lever 60 from its influence (see e.g., FIG. 7). When the ice mold 14 is later rotated back to its home position, the retention arm 66 will again engage the detection lever 60. If the detection lever 60 is positioned downward from its retracted position, the retention arm 66 will pull the detection lever 60 back to its retracted position as the ice mold 14 returns to its home position. Alternatively, if the detection lever 60 is still in its retracted position (due to, for example, the interference of ice accumulated below the detection lever 60), the retention arm 66 will simply engage the detection lever 60 when the ice mold 14 returns to its home position.

Thus, the retention arm 66 will retain the detection lever 60 in its retracted position whenever the ice mold 14 is in its home position, thereby facilitating user access to ice stored in a bin below the ice maker 10.

In addition or alternatively, the retention mechanism 64 can include a retention lever 70 that is configured to retain the detection lever 60 in its retracted position whenever the ice mold 14 is in its harvest position. More specifically, the retention lever 70 in the illustrated embodiment has a mounting collar 74 with an aperture 76 extending therethrough, and first and second lever arms 78, 80 extending radially from the collar 74 (the radial direction being defined by the central axis of the collar 74). The retention lever 70 is rotatably coupled to a mounting shaft 82 of the carriage 12 by sliding its collar 74 onto the shaft 82, and will normally be free to rotate about the shaft 82. However, the retention lever's range of rotation can be limited by various structure. For example, the collar 74 of the retention lever 70 can have a plurality of collar projections 84 projecting inward toward the center of its aperture 76, and the shaft 82 can have a plurality of shaft projections 86 projecting radially outward that are configured to limit the range of rotation of the retention lever 70 about the shaft 82 by engaging (e.g., contacting) the collar projections 84 as the retention lever 70 is rotated. The total range of rotation possible for the retention lever 70 about the shaft 82 can be between 90° and 210°, and preferably between 120° and 184°, and still more preferably about 150°, although other ranges are possible other embodiments.

The actuation member 72, meanwhile, is fixed to (e.g., made integral with) the ice mold 14 and projects from the end portion 18*a* substantially parallel to the axis $X_R$ (e.g., within 5 degrees or less of parallel to the axis $X_R$). The actuation member 72 as illustrated is a cylindrical body, although other shapes and configurations are possible in other embodiments.

During an ice harvest operation, the ice mold 14 can be rotated away from its home position toward its harvest position, causing the retention arm 66 of the ice mold 14 to disengage from and release the detection lever 60 as discussed above (if the detection lever 60 is stuck in its retracted position, the retention arm 66 can be configured to briefly press the detection lever 60 downward to help release the detection lever 60). As the detection lever 60 moves toward its extended position, it will engage (e.g., contact) the first lever arm 78 of the retention lever 70 and cause the retention lever 70 to move in a first direction $R_1$ about its mounting shaft 82 until the detection lever 60 comes to rest (see e.g., FIG. 7). At this stage, it can be determined whether ice should be harvested based on the rest position of the detection lever 60 (as discussed above).

If no harvesting is desired, the ice mold 14 can be returned to its home position, and the retention arm 66 of the ice mold 14 will re-engage the detection lever 60 as the ice mold 14 is rotated back to its home position to return the detection lever 60 back to its retracted position. However, if harvesting is desired, the ice mold 14 can finish rotating to its harvest position. As the ice mold 14 approaches the harvest position, the actuation member 72 fixed to the ice mold 14 will engage (e.g., contact) the second lever arm 80 of the retention lever 70, causing the retention lever 70 to rotate in a second direction $R_2$ about its mounting shaft 82, thereby lifting the detection lever 60 toward its retracted position via its engagement with the first lever arm 78 of the retention lever 70. The retention lever 70 will continue to rotate and lift the detection lever 60 until the ice mold 14 assumes its harvest position and the detection lever 60 assumes its retracted position. Thus, the retention lever 70 will retain the detection lever 60 in its retracted position whenever the ice mold 14 is in its harvest position, thereby allowing ice to eject from the ice mold 14 without interference with the detection lever 60.

Once harvesting is complete, the ice mold 14 can be rotated from the harvest position back to its home position. As the ice mold 14 leaves the harvest position, the actuation member 72 fixed to the ice mold 14 will disengage from the second lever arm 80 of the retention lever 70, and the retention lever 70 will no longer exert a retention force on the detection lever 60. However, as the ice mold 14 completes its rotation to the home position, the retention arm 66 of the ice mold 14 will re-engage the detection lever 60 and retain the detection lever 60 accordingly.

The features of the retention mechanism 64 as illustrated and described above can comprise a variety of different shapes, sizes, and configurations without departing from the scope of the invention. Broadly speaking, the retention mechanism 64 can comprise any configuration of elements that will retain the detection lever 60 in its retracted position when the ice mold 14 is in its home and/or harvest positions.

V. Drive Arm

In some cases, the detection lever 60 may seize up and remain in its retracted position upon release from the retention arm 66, even if there is no ice accumulated below the detection lever 60. This may occur if, for example, moisture collects and freezes at the point of attachment between the detection lever 60 and carriage 12. If the detection lever 60 does seize up, it may not properly indicate the presence or absence of ice below the detection lever 60, since it will remain in the retracted position regardless of the presence or absence of ice.

Accordingly, the ice maker 10 can comprises a drive arm that is configured to dislodge the detection lever 60 if it does seize up. For example, the drive arm in the illustrated embodiment corresponds to the retention arm 66. As discussed above, the retention arm 66 will disengage from and release the detection lever 60 as the ice mold 14 is rotated from the home position toward its harvest position. However, if the detection lever 60 remains in the retracted position upon release from the retention arm 66, the retention arm 66 can be configured to re-engage (e.g., contact) the detection lever 60 as the ice mold 14 continues to move to the harvest position, thereby exerting force on the detection lever 60 toward the extended position. This force can help dislodge detection lever 60 if it is indeed seized.

It is to be appreciated that the drive arm may be separate from the retention arm 66 in other examples. Indeed, the drive arm can be any structure configured to exert force on the detection lever 60 toward the extended position as the ice mold 14 is moved from the home position to the harvest position if the detection lever 60 remains in the retracted position upon release from the retention arm 66.

VI. Control System

Turning back to FIGS. 2 & 3, the ice maker 10 can further include a control system 90 for sensing and controlling various aspects of the ice maker 10. The control system 90 can include a programmable controller 92 (e.g., microcontroller, PLC, etc.) that is operatively coupled to the drive assembly 24 (e.g., electrically coupled to the motor 26) and programmed to perform one or more operations, as will be described later below. The control system 90 can further include a sensor assembly 94 that is configured to detect a predetermined position (e.g., the extended position or retracted position) of the detection lever 60 and provide an output to the controller 92 indicating whether the detection lever 60 is in the predetermined position.

For instance, in the illustrated embodiment, the sensor assembly 94 includes a sensor 96 in the form of a Hall Effect switch that is fixed to the carriage 12. The sensor 96 includes a pair of contacts that are electrically coupled to the controller 92 and normally biased open (e.g., via ferromagnetic metal reeds). When the contacts are closed, the sensor 96 will complete a circuit with the controller 92 and output a positive signal to the controller 92 indicating that the switch is closed. When the contacts are opened, the circuit will be broken and the sensor 96 will output a zero signal to the controller 92 indicating that the switch is open.

The sensor assembly 94 in the illustrated embodiment further includes an actuation member 98 in the form of a magnetic body that is fixed to the detection lever 60. The magnetic body produces a magnetic field that is configured to close the sensor's pair of contacts when within a certain vicinity of the sensor 96. In particular, the sensor 96 and actuation member 98 are arranged on the carriage 12 and detection lever 60 such that the actuation member 98 will engage the sensor 96 when the detection lever 60 is in its extended position, thereby closing the contacts of the sensor 96 and outputting a positive signal to the controller 92 indicating that the detection lever 60 is in its extended position. Meanwhile, when the detection lever 60 is away from the extended position (e.g., the retracted position), the actuation member 98 will not engage the sensor 96, and the sensor 96 will output a zero signal to the controller 92 indicating that the detection lever 60 is not in the extended position.

Thus, the sensor assembly 94 in the illustrated embodiment is configured to detect a predetermined position corresponding to the extended position of the detection lever 60, and will provide an output (i.e., positive or zero signal) indicating whether the detection lever 60 is in the extended position. However, the sensor assembly 94 can be configured in a variety of different manners that can detect a predetermined position of the detection lever 60 and send an output indicating whether the detection lever 60 is in the predetermined position. For example, the sensor 96 can be fixed to the detection lever 60 and the actuation member 98 is fixed to the carriage 12. As another example, the sensor 96 and actuation member 98 can be configured to detect the retracted position of the detection lever 60. As yet another example, the sensor 96 can be configured to output a zero signal to the controller 92 when the detection lever 60 is in its predetermined position, and a positive signal when the detection lever 60 is not in its predetermined position.

The sensor assembly 94 described above is an example of a "non-contact" sensor assembly, meaning that the sensor 96 and the actuation member 98 do not need to physically contact each other for the actuation member 98 to engage the sensor 96. This can be beneficial in cold environments wherein frost can accumulate on sensor components and inhibit them from directly contacting each other. It is to be appreciated that the sensor assembly 94 may comprise other types of sensors and actuation members than that described above to form a non-contact sensor assembly. Moreover, in some embodiments, the sensor assembly 94 may comprise a sensor that requires contact from an actuation member for the sensor to be engaged.

In some examples, the control system 90 can include a temperature sensor 104 (e.g., thermistor, thermocouple, etc.) electrically coupled to the controller 92 that is configured to detect temperature. In the present embodiment, the temperature sensor 104 is a thermistor having a resistance that varies with temperature. Moreover, the control system 90 includes wire assembly 106 that is coupled at one end 108 to the temperature sensor 104 and is coupled at another end 110 to the controller 92 to electrically connect the controller 92 and temperature sensor 104. The wire assembly 106 includes an input line and an output line that enable the controller 92 to provide an electrical current through the temperature sensor 104 and determine the present resistance of the temperature sensor 104. In this manner, the temperature sensor 104 detects temperature by providing a resistance that corresponds to its temperature, and the controller 92 can monitor the temperature detected by the temperature sensor 104.

Figure 8:
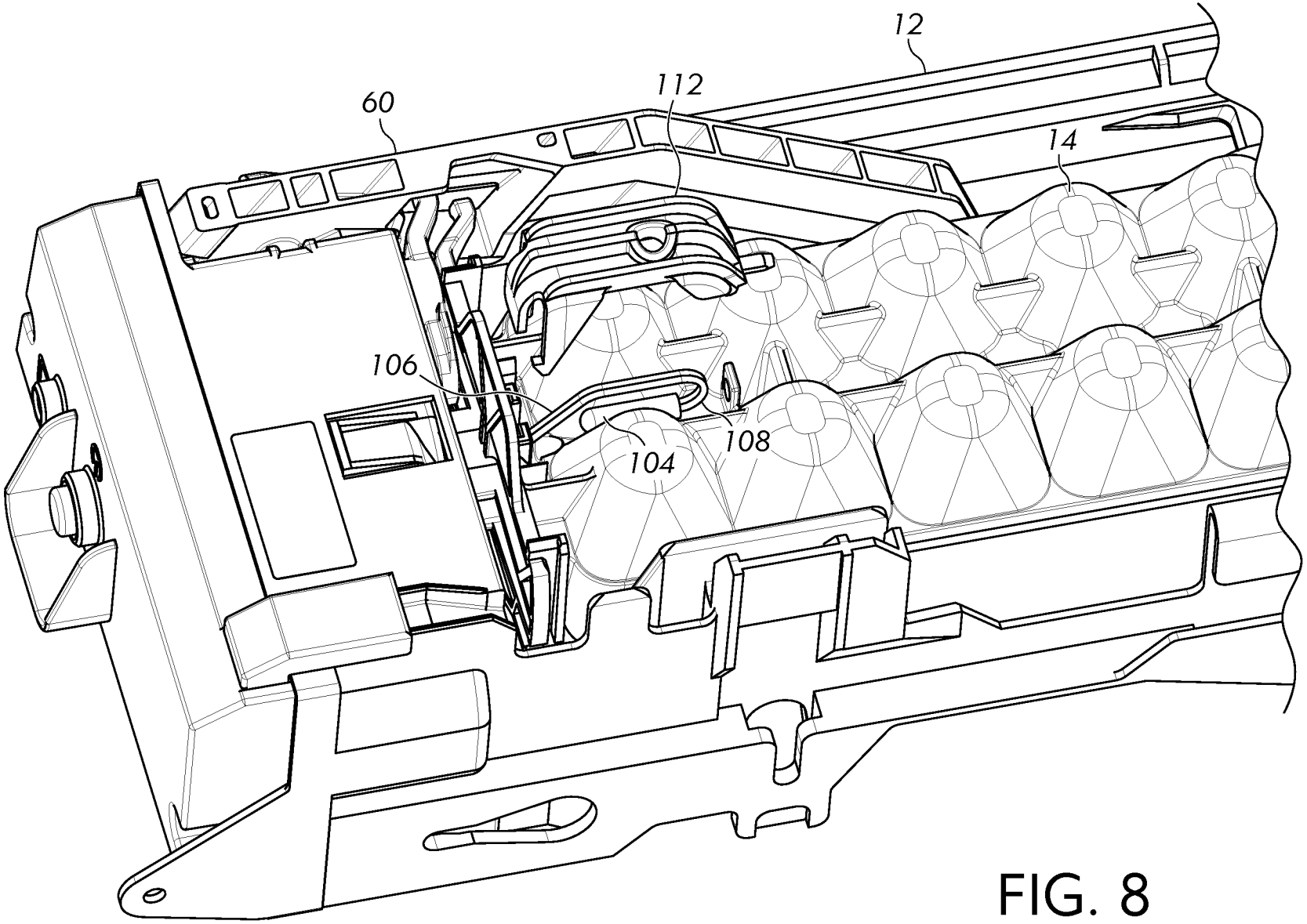
FIG. 8 is a bottom-perspective view of the ice maker.

The temperature sensor 104 is preferably arranged near to or in contact with a portion of the ice mold 14 that will closely match in temperature to any water/ice contained in its cavities 16. For instance, as shown in FIG. 8, the temperature sensor 104 can be fixed in direct contact to an underside of the ice mold 14, between two adjacent cavities 16. The temperature sensor 104 can thus detect the temperature of this portion of the ice mold 14, which will be close in temperature to any water/ice contained in the two adjacent cavities 16. Moreover, an insulated cover 112 can be provided that covers the temperature sensor 104 and inhibits the rest of the environment from influencing the temperature sensor 104. However, it is to be appreciated that the temperature sensor 104 and cover 112 may be arranged at other portions of the ice mold 14, either directly contacting, indirectly contacting, or spaced from the ice mold 14. Indeed, the temperature sensor 104 and cover 112 may be arranged in any location as desired without departing from the scope of the invention.

As noted above, the control system 90 can include a wire assembly 106 that is coupled at one end 108 to the temperature sensor 104 and is coupled at another end 110 to the controller 92 to electrically connect the controller 92 and temperature sensor 104. In embodiments wherein the temperature sensor 104 is fixed to the ice mold 14 and the controller 92 is fixed on the carriage 12 or some other stationary member, rotation of the ice mold 14 between its home and harvest positions will cause the one end 108 of the wire assembly 106 to move with the ice mold 14, which could cause the wire assembly 106 to twist and/or get caught on a component of the ice maker 10.

Accordingly, the wire assembly 106 in the illustrated embodiment is configured to pass through the coupling element 20*a* of the ice mold 14 and the drive shaft 30 of the drive assembly 24. More specifically, the mating hole 42 of the coupling element 20*a* described above is a through hole that extends completely through the coupling element 20*a* along the axis $X_R$. Moreover, the drive shaft 30 similarly has a through hole 116 that extends completely through the drive shaft 30 along the axis $X_R$. The wire assembly 106 is configured such that it passes through both holes 42, 116 of the coupling element 20*a* and drive shaft 30. In this manner, the segment of the wire assembly 106 passing through the holes 42, 116 will reside along or near to the axis $X_R$, and will not substantially move as the ice mold 14 is rotated between its home and harvest positions. Even if it moves, the segment will simply move within the holes 42, 116 with little or no risk of catching on a component of the ice maker 10. Likewise, the segment of the wire assembly 106 between the controller 92 and the drive shaft 30 will not substantially move as the ice mold 14 is rotated between its home and harvest positions.

The only segment of the wire assembly 106 that will significantly move during rotation of the ice mold 14 is the segment between the coupling element 20*a* and the temperature sensor 104. However, this segment can be fed along and fixed to the ice mold 14 to inhibit the segment from catching on another component of the ice maker 10 during rotation. Moreover, by arranging the temperature sensor 104 near the end portion 18*a* of the ice mold 14, the segment of the wire assembly 106 between the coupling element 20*a* and the temperature sensor 104 can be relatively small, further reducing the risk of the segment from catching on another component of the ice maker 10.

In some examples, the control system 90 can include a sensor assembly 118 (see FIG. 5) that is configured to detect a position of the ice mold 14 and provide an output to the controller 92 indicating the position. In the illustrated embodiment, the sensor assembly 118 corresponds to a rotary encoder that is coupled to the drive shaft 30 for the ice mold 14 such that the rotary encoder can detect a current position of the drive shaft 30 (which corresponds to the position of the ice mold 14). Moreover, the sensor assembly 118 is electrically coupled to the controller 92 and will transmit an output to the controller 92 indicating the current position the drive shaft 30 and corresponding ice mold 14. In this manner, the controller 92 can monitor the current position of the ice mold 14.

However, the sensor assembly 118 can comprise a variety of other configurations for detecting a position of the ice mold 14. For instance, the sensor assembly 118 can comprise one or more microswitches or proximity sensors that will be engaged when the ice mold 14 assumes a predetermined position (e.g. the retracted position or extended position). In some examples, the sensor assembly 118 may comprise a non-contact sensor and actuation member similar to the sensor 96 and actuation member 98 of the sensor assembly 94 described above.

The control system 90 can further include a user interface 120 (see e.g., FIGS. 1 & 3) that is operatively coupled to the controller 92 and is configured to enable interaction and communication between a user and the controller 92. For example, the user interface 120 can include one or more input elements 122 (e.g., buttons, switches, touchscreens, microphones, etc.) that each enable a user to provide one or more inputs to the controller 92. In the illustrated embodiment, the user interface 120 includes one input 122 in the form of a push-button that can provide multiple different inputs to the controller 92 by varying the length in which the push-button is pressed inward. The user interface 120 can further include one or more indicator elements 124 (e.g., light modules, speakers, displays, etc.) that can be operated by the controller 92 to indicate certain information to a user. In the illustrated embodiment, the user interface 120 includes one indicator 124 in the form of an LED light module that can be lit in various manners (e.g., persistently, blinking, etc.) to indicate different information to a user.

Figure 9:
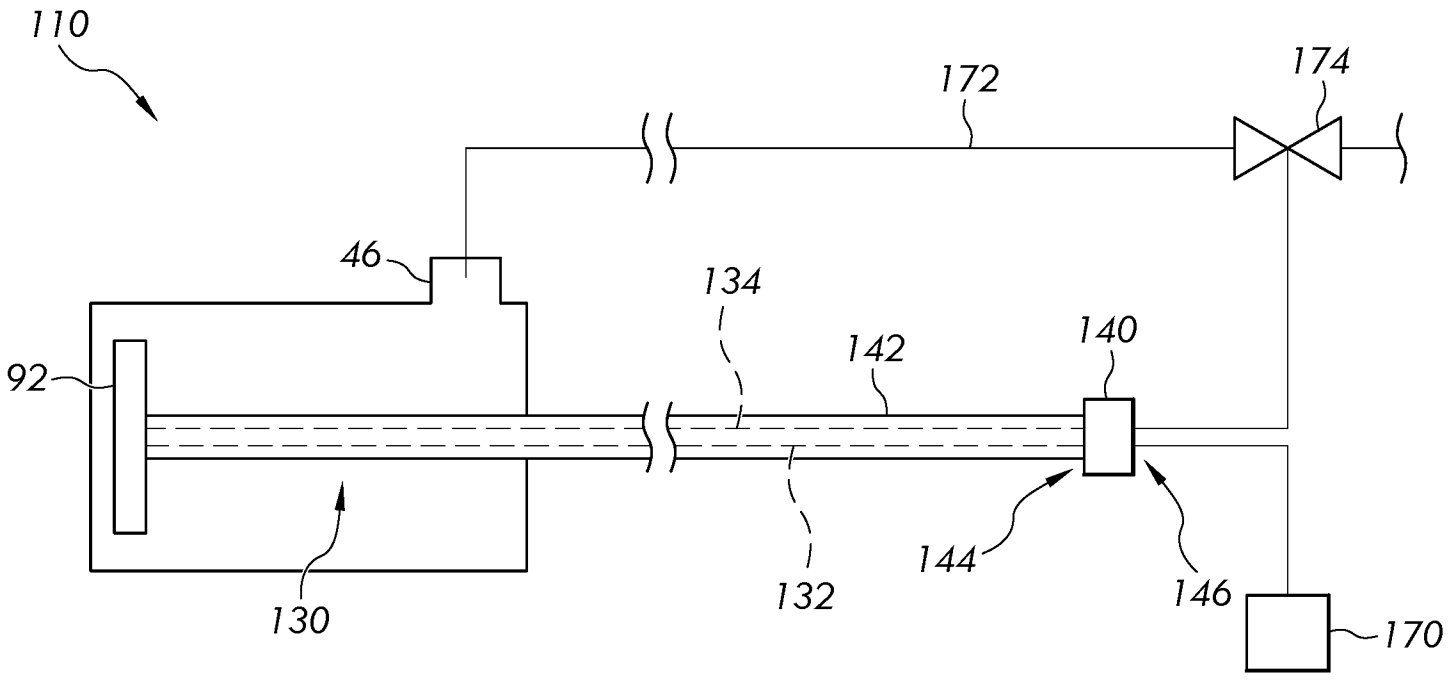
FIG. 9 is a schematic view of the ice maker electrically connected to a power supply and water valve of an appliance.

The control system 90 can further include a cable assembly 130 (see e.g., FIG. 9) that is electrically coupled to the controller 92 and can provide communication between the controller 92 and one or more features of an appliance in which the ice maker 10 is installed. More specifically, the cable assembly 130 can include a power line 132 for transmitting power (e.g., AC or DC power) from a power inlet of the appliance to the controller 92, and one or more control lines 134 for transmitting a control signal from the controller 92 to a feature of the appliance (or vice versa). In the illustrated embodiment, the cable assembly 130 includes a single power line 132 that is configured for AC power and can include a hot wire, a neutral wire, and a ground wire. Moreover, the cable assembly 130 has a single control line 134 for transmitting a control signal from the controller 192 to a water valve of an appliance in which the ice maker 10 will be installed.

Each power line 132 and control line 134 of the cable assembly 130 can terminate at one end to the controller 92 and terminate at the other end to a common connector 140, which enables the power line 132 and control line(s) 134 to be electrically connected to associated features of the appliance. Moreover, the cable assembly 130 can include an insulating sheath 142 that surrounds the lines 132, 134 of the cable assembly 130 and extends at least partially along the lines 132, 134 between the controller 92 and the connector 140.

The connector 140 in the present embodiment is a terminal block having terminals on a first side 144 of the connector 140 for connection to the power line 132 and control line(s) 134 of the cable assembly 130, and terminals on a second side 146 of the connector 140 for connection to the associated features of the appliance. In this manner, features of an appliance can be electrically connected to the power line 132 and control line 134 of the cable assembly 130 by connecting the features to the appropriate terminals on the second side 146 of the connector 140. However, the connector 140 can comprise any type of connector that enables the power line 132 and control line 134 to be electrically connected to associated features of an appliance.

The control system 90 of the ice maker 10 as described above is "self-contained", meaning that its components are all supported by the carriage 12 of the ice maker 10 and the only outside input to the control system 90 is power (e.g., from an appliance via the power line 132 of the cable assembly 130). In this manner, the ice maker 10 can be a modular unit that is easily installed in (or removed from) an appliance without having to connect the control system 90 with (or disconnect the control system 90 from) several control devices in the appliance. Moreover, the appliance itself does not have be equipped with control devices such as a controller or sensor assembly that are specific to the ice maker 10, and therefore can be universally manufactured for use with various different ice makers 10.

VII. Installation

Figure 10:
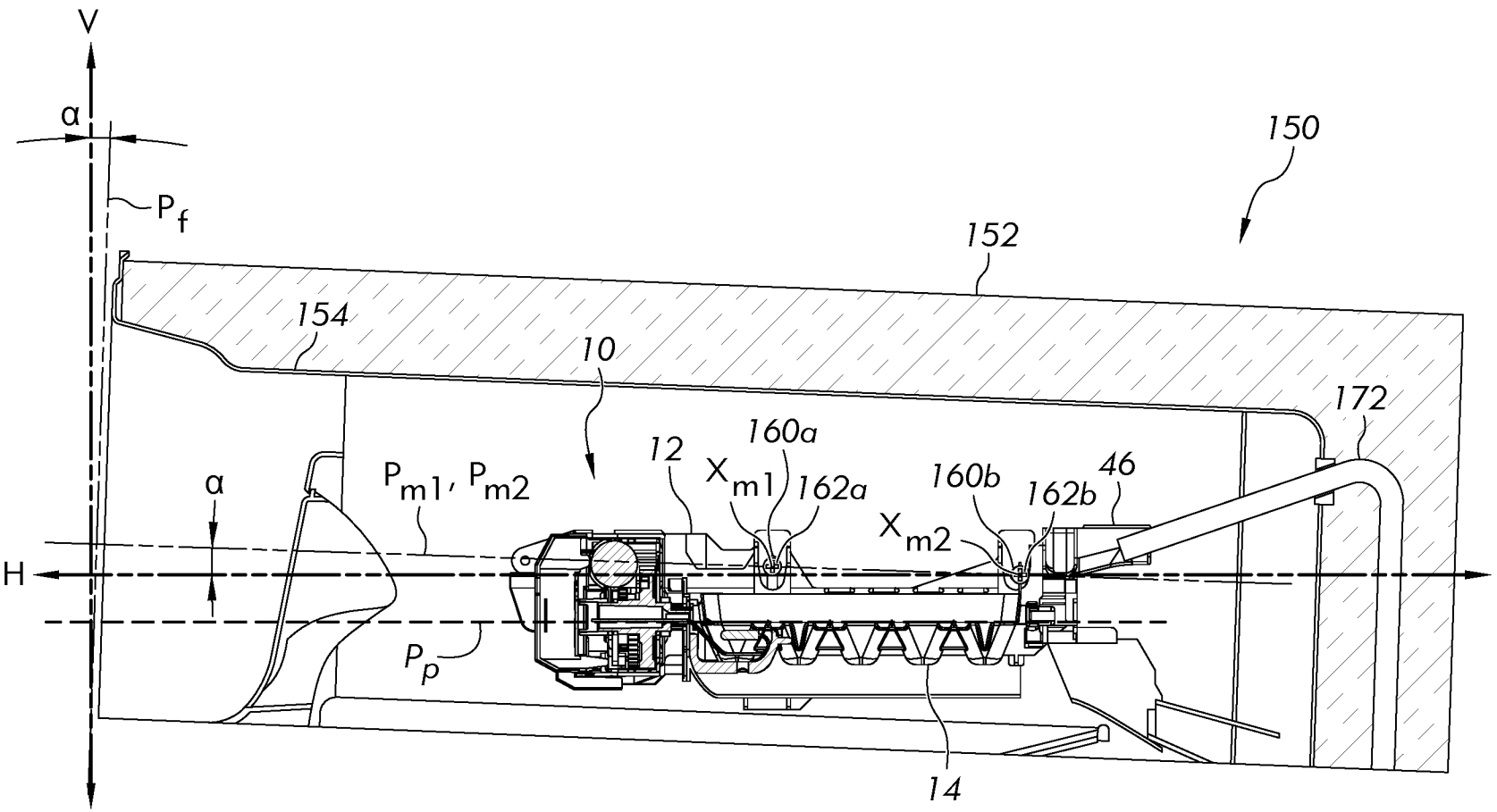
FIG. 10 is a cross-section view of the ice maker installed within a compartment of the appliance.

As shown in FIG. 10, the ice maker 10 described above can be installed in an appliance 150 having a cabinet 152 that defines one or more compartments 154. In the present embodiment, the appliance 150 corresponds to a refrigerator, and the ice maker 10 is installed within a freezer compartment 154 defined by the cabinet 152. However, the appliance 150 may correspond to other types of appliances in other embodiments, and the ice maker 10 can be installed in other types of compartment 154 of the appliance 150.

The appliance 150 can be configured such that its cabinet 152 is slightly tilted with respect to a vertical axis V and a horizontal axis H. Specifically, a front plane $P_f$ defined by a front of the cabinet 152 can be oblique to the vertical axis V such that the front plane $P_f$ is tilted by a predetermined angle $\alpha$ with respect to the vertical axis V. The predetermined angle $\alpha$ will be preferably between 1° and 5° and more preferably about 2°, although other angles are possible in other embodiments. This tilt of the cabinet 152 is designed so that any door rotatably attached to the front of the cabinet 152 can be biased by gravity towards a closed position.

Meanwhile, the ice maker 10 can be configured such that when installed in the appliance 150 the primary plane $P_p$ of the ice maker 10 is substantially parallel to a horizontal axis H (e.g., within 0.5 degrees or less of parallel to the horizontal axis H). This is preferred so that water can evenly fill the cavities 16 of the ice mold 14 when poured into the ice mold 14 in its home position.

In order to install the ice maker 10 in this manner, the ice maker 10 can include a first mounting element 160*a* and a second mounting element 160*b* (seen best in FIG. 2) for mounting the ice maker 10 to the appliance 150, wherein the mounting elements 160*a*, 160*b* respectively define mounting axes $X_{M1}$, $X_{M2}$. In the illustrated embodiment, the mounting elements 160*a*, 160*b* correspond to apertures defined by the carriage 12 that fasteners 162*a*, 162*b* (e.g., mounting screws) will pass through to fix the carriage 12 to a side wall of the compartment 154. Moreover, the mounting axes $X_{M1}$, $X_{M2}$ correspond to the axes in which the fasteners 162*a*, 162*b* will coincide with when passing through the apertures to fix the carriage 12 to the compartment 154.

The mounting axes $X_{M1}$, $X_{M2}$ of the mounting elements 160*a*, 160*b* extend substantially parallel to each other and the primary plane $P_p$ of the ice maker 10 (e.g., within 0.5 degrees or less of parallel to each other and the primary plane $P_p$). However, the mounting axes $X_{M1}$, $X_{M2}$ are spaced from each other and extend along a common mounting plane $P_{m1}$ of the ice maker 10 that is oblique to the primary plane $P_p$. In particular, the mounting plane $P_{m1}$ forms an angle $\alpha$ with the primary plane $P_p$ that corresponds to the predetermined angle $\alpha$ discussed above. Moreover, the first mounting aperture 160*a* extends farther from the primary plane $P_p$ than the second mounting aperture 160*b*. Meanwhile, the fasteners 162*a*, 162*b* will be screwed into corresponding holes in the side wall of the compartment 154 that are aligned along a mounting plane $P_{m2}$ of the appliance 150 that is substantially perpendicular to its front plane $P_f$ (e.g., within 0.5 degrees or less of perpendicular to the front plane $P_f$).

By way of the spatial relationships described above, the primary plane $P_p$ of the ice maker 10 when installed in the appliance 150 will be substantially parallel to a horizontal axis H (e.g., within 0.5 degrees or less of parallel to the horizontal axis H). Such horizontal positioning can ensure that the ice mold cavities 16 fill evenly and the temperature sensor 104 is positioned properly to indicate when the cavities 16 are filled with ice.

However, it is to be appreciated that the mounting elements 160*a*, 160*b* may be configured differently in other embodiments and still achieve similar results. For example, although mounting elements 160*a*, 160*b* in the illustrated embodiment are elongated apertures, the mounting elements 160*a*, 160*b* in other examples can be circular apertures, and the mounting axes $X_{M1}$, $X_{M2}$ of the mounting elements 160*a*, 160*b* can coincide with the centers of the circular apertures. In other examples, the mounting elements 160*a*, 160*b* can be cylindrical projections defined by the carriage 12 that are inserted into mating apertures of the cabinet 152, and the mounting axes $X_{M1}$, $X_{M2}$ of the mounting elements 160*a*, 160*b* can coincide with the central axes of the cylindrical projections.

Moreover, in some examples, the ice maker 10 may simply be mounted in the appliance 150 such that its primary plane $P_p$ is substantially parallel to the mounting plane $P_{m2}$ of the appliance 150. The ice maker 10 can be mounted in a variety of different manners and/or orientations without departing from the scope of this disclosure.

Turning back to FIG. 9, the appliance 150 can include an AC power inlet 170 (e.g., power cord), a water line 172, and a valve 174. An outlet of the water line 172 can be arranged at the water slide 46 of the ice maker 10 when the ice maker 10 is installed in the appliance 150.

The AC power inlet 170 can be electrically connected to the power line 132 of the cable assembly 130 by connecting the AC power inlet 170 to the power line's associated terminal(s) on the second side 146 of the connector 140, thereby enabling the AC power inlet 170 to supply AC power to the controller 92. Likewise, the valve 174 can be electrically connected to the control line 134 of the cable assembly 130 by connecting the valve 174 to the control line's associated terminal(s) on the second side 146 of the connector 140. In this manner, the controller 92 can selectively provide a control signal (e.g., positive or zero voltage) to the control line 134 to operate the valve 174 and fill the ice mold 14 of the ice maker 10 with water, as discussed further below.

More specifically, the valve 174 in the present embodiment is a solenoid valve that will normally be closed, thereby preventing water from being fed from an upstream water source through the valve 174 and into the water line 172. When the controller 92 provides a positive voltage (e.g., 85-265 VAC at 50-60 Hz) to the control line 134, this voltage will generate a current through the control line 134 and valve 174 that operates to open the valve 174, thereby permitting water to flow through the valve 174 and into the water line 172. Conversely, when the controller 92 provides zero voltage to the control line 134, the valve 174 will close. In this manner, the controller 92 can selectively open and close the valve 174 to fill the ice mold 14 of the ice maker 10 with water as desired.

However, in other examples, the valve 174 can be normally open, and the controller 92 can selectively apply a positive voltage and zero voltage to the control line 134 to close and open the valve 174 respectively.

VIII. Operations

Figure 11:
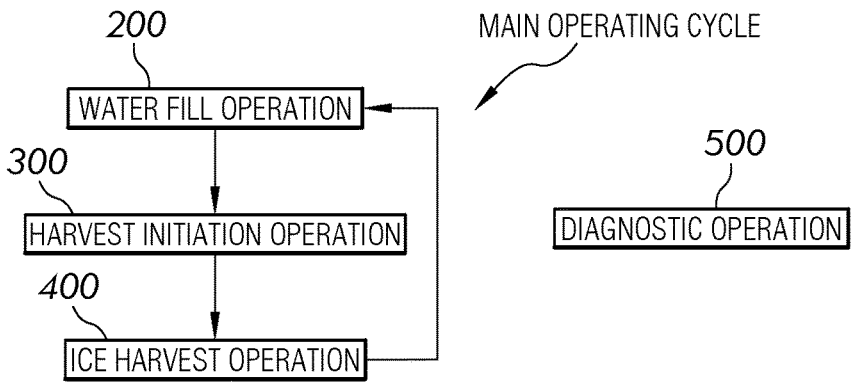
FIG. 11 schematically illustrates various operations for the ice maker.

Turning to FIG. 11, various operations are illustrated that can be performed with the ice maker 10 described above. In particular, FIG. 11 shows a water fill operation 200, a harvest initiation operation 300, an ice harvest operation 400, and a diagnostic operation 500 that can all be performed with the ice maker 10, and will be described below in further detail. These operations can be programmed into the controller 92 of the ice maker 10, and the controller 92 can be configured to control and/or communicate with various features of the ice maker 10 to perform the operations automatically. In particular, the controller 92 can perform one or more of the operations automatically in response to an input (e.g., a start command) provided manually by a user to the controller 92 via the user interface 120, and/or some other input to the controller 92 (e.g., an output of a sensor assembly).

As shown in FIG. 11, the water fill operation 200, harvest initiation operation 300, and ice harvest operation 400 can form a main operating cycle for the ice maker 10. The controller 92 can be configured such that upon startup of the ice maker 10, the ice maker 10 will enter this main operating cycle with the ice mold 14 at its home position. The ice maker 10 can enter anywhere along the main operating cycle. Meanwhile, the diagnostic operation 500 is a separate operation that can be initiated to break the main operating cycle and run separately from the main operating cycle. In some cases, the controller 92 can be configured to return the ice maker 10 to the main operating cycle upon completion of the diagnostic operation 500.

However, it is to be appreciated that one or more of the operations in FIG. 11 may be excluded in some embodiments of the ice maker 10. Moreover, one or more of the operations (or steps within the operations) can be performed manually by a user, with no assistance from the controller 92.

The operations in FIG. 11 will now be described in further detail with respect to an embodiment of the ice maker 10 that is configured as shown in FIGS. 1-10. However, it is to be appreciated that the operations or variations thereof may be used with other embodiments of the ice maker 10 as appropriate.

A. Water Fill Operation

The controller 92 can initiate the water fill operation 200 while the ice mold 14 is in its home position. For example, the controller 92 can initiate the water fill operation 200 in response to a start command manually provided by a user to the controller 92 via the user interface 120. In addition or alternatively, the controller 92 can initiate the water fill operation 200 in response to the ice maker 10 being powered on.

The water fill operation 200 comprises selectively providing a control signal (e.g., positive or zero voltage) to the control line 134 of the cable assembly 130 for a predetermined amount of time. In the present embodiment, this control signal corresponds to a positive voltage (e.g., 85-265 VAC at 50-60 Hz), which is provided by the controller 92 to the control line 134 and can open the water valve 174 discussed above to supply water to the ice maker 10. The predetermined amount of time in which the control signal is provided can vary in different embodiments, but will preferably correspond to the length of time required to fill the cavities 16 of the ice mold 14 with water when the cavities 16 are completely empty.

In the present embodiment, the water fill operation 200 when performed will fill the cavities 16 of the ice mold 14 with the same amount of water. However, in other embodiments, the water fill operation 200 may vary the amount of water poured into the cavities 16 (e.g., based on a water level input provided by a user to the controller 92 via the user interface 120).

B. Harvest Initiation Operation

Figure 12:
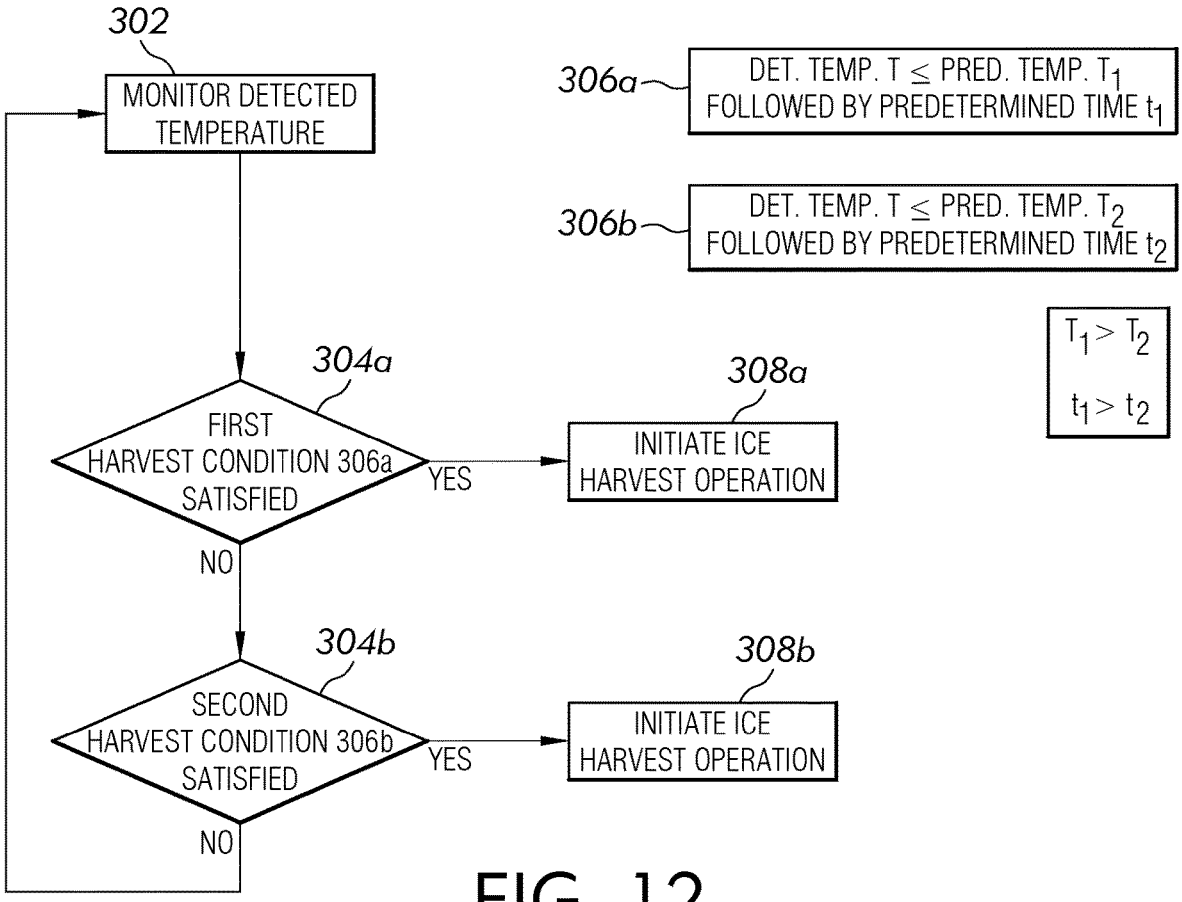
FIG. 12 schematically illustrates a harvest initiation operation for the ice maker.

Once the cavities 16 of the ice mold 14 have been filled with water by the water fill operation 200, the water can be cooled to a frozen state and then harvested by the ice harvest operation 400 discussed further below. However, before proceeding to the ice harvest operation 400, the controller 92 can perform a harvest initiation operation 300 (see FIG. 12) in response to completion of the water fill operation 200. The harvest initiation operation 300 will monitor various parameters of the ice maker 10 and initiate the ice harvest operation 400 once the water/ice in the ice mold 14 is ready for harvesting.

More specifically, the harvest initiation operation 300 comprises a monitoring step 302 of monitoring the temperature detected by the temperature sensor 104 (e.g., the resistance of the temperature sensor 104, which corresponds to its temperature). This monitoring step 302 can be performed by the controller 92, which is electrically coupled to the temperature sensor 104 as discussed above.

The harvest initiation operation 300 can further comprise one or more determining steps 304 that will each determine if a particular harvest condition 306 has been satisfied indicating that the water in the ice mold 14 is frozen and ready for harvesting. Moreover, each determining step 304 can be associated with an initiation step 308 that will initiate the ice harvest operation 400 if the harvest condition 306 of that determining step 304 is satisfied.

For example, the harvest initiation operation 300 can include a first determining step 304*a* of determining if a first harvest condition 306*a* is satisfied during the monitoring step 302, and a first initiating step 308*a* of initiating the ice harvest operation 400 if the determining step 304*a* determines that the first harvest condition 306*a* is satisfied during the monitoring step 302. These steps 304*a*, 308*a* can both be performed by the controller 92 with its internal logic.

The first harvest condition 306*a* requires that the temperature sensor 104 detects a temperature T equal to or below a first predetermined temperature $T_1$ (e.g., −7° C. or less), and then a first predetermined amount of time $t_1$ (e.g., 3 minutes or more) elapses. The predetermined amount of time $t_1$ will begin immediately upon detection of the temperature T, and the initiating step 308*a* will initiate the ice harvest operation 400 immediately upon completion of the predetermined amount of time $t_1$. However, the predetermined amount of time $t_1$ and/or initiation of the ice harvest operation 400 may be delayed in other examples. Moreover, the first harvest condition 306*a* may or may not require that the detected temperature T be equal to or below the predetermined temperature $T_1$ for the duration of the predetermined amount of time $t_1$.

The harvest initiation operation 300 can also include a second determining step 304*b* of determining if a second harvest condition 306*b* is satisfied during the monitoring step 302, and a second initiating step 308*b* of initiating the ice harvest operation 400 if the determining step 304*b* determines that the second harvest condition 306*b* is satisfied during the monitoring step 302. These steps 304*b*, 308*b* can also be performed by the controller 92 with its internal logic.

The second harvest condition 306*b* requires that the temperature sensor 104 detects a temperature T equal to or below a second predetermined temperature $T_2$ (e.g., −10° C. or less), and then a second predetermined amount of time $t_2$ (e.g., between 10 and 30 seconds) elapses. The predetermined amount of time $t_2$ will begin immediately upon detection of the temperature T, and the initiating step 308*b* will initiate the ice harvest operation 400 immediately upon completion of the predetermined amount of time $t_2$. However, the predetermined amount of time $t_2$ and/or initiation of the ice harvest operation 400 may be delayed in other examples. Moreover, the second harvest condition 306*b* may or may not require that the detected temperature T be equal to or below the predetermined temperature $T_2$ for the duration of the predetermined amount of time $t_2$.

Thus, the harvest initiation operation 300 will initiate the ice harvest operation 400 upon satisfaction of either of the first and second harvest conditions 306*a*, 306*b*. Moreover, the predetermined temperatures $T_1$, $T_2$ and amounts of time $t_1$, $t_2$ of the first and second harvest conditions 306*a*, 306*b* can be set to ensure that water in the cavities 16 of the ice mold 14 is frozen all the way through. Although these temperatures and times can vary in different embodiments, the predetermined temperature $T_1$ of the first harvest condition 306*a* will preferably be greater than the predetermined temperature $T_2$ of the second harvest condition 306*b*. Additionally, the predetermined amount of time $t_1$ of the first harvest condition 306*a* will preferably be greater than the predetermined amount of time $t_2$ of the second harvest condition 306*b*. For example, the predetermined temperature $T_1$ and amount of time $t_1$ of the first harvest condition 306*a* can be set respectively to −10° C. and 3 minutes, while the predetermined temperature $T_2$ and amount of time $t_2$ of the second harvest condition 306*b* can be set respectively to −12° C. and 10 seconds.

The inventors have found that by providing the first harvest condition 306*a* with a relatively high predetermined temperature $T_1$ and amount of time $t_1$ and the second harvest condition 306*b* with a relatively low predetermined temperature $T_2$ and amount of time $t_2$, ice harvesting performance of the ice maker 10 can be improved.

For example, if the harvest initiation operation 300 merely initiated the ice harvest operation 400 in response to the second harvest condition 306*b* having a predetermined temperature $T_2$ of −12° C. and a predetermined amount of time $t_2$ of 10 seconds, there may arise a condition wherein the temperature sensor 104 detects a temperature T of −10° C. for a long enough time (e.g., 3 minutes) that ice should be formed in the ice mold 14, but the second harvest condition 306*b* would not be satisfied. Conversely, if the harvest initiation operation 300 merely initiated the ice harvest operation 400 in response to the first harvest condition 306*a* having a predetermined temperature $T_1$ of −10° C. and a predetermined amount of time $t_1$ of 3 minutes, there may arise a condition wherein the temperature sensor 104 detects a low enough temperature T (e.g., −12° C.) that it is not necessary to wait the full predetermined amount of time $t_1$ of 3 minutes to ensure that ice if formed in the ice mold 14. Accordingly, by initiating the ice harvest operation 400 in response to either of the first and second harvest conditions 306*a*, 306*b*, ice harvesting performance of the ice maker 10 can be improved.

It is to be appreciated that the harvest initiation operation 300 may be configured to initiate the ice harvest operation 400 in response to additional harvest conditions with different predetermined temperatures and amounts of time than the first and second harvest conditions 306*a*, 306*b* above. Moreover, the harvest initiation operation 300 may initiate the ice harvest operation 400 in response to one or more alternative conditions than those described above (e.g., a start command from the user interface 120).

C. Ice Harvest Operation

Figure 13:
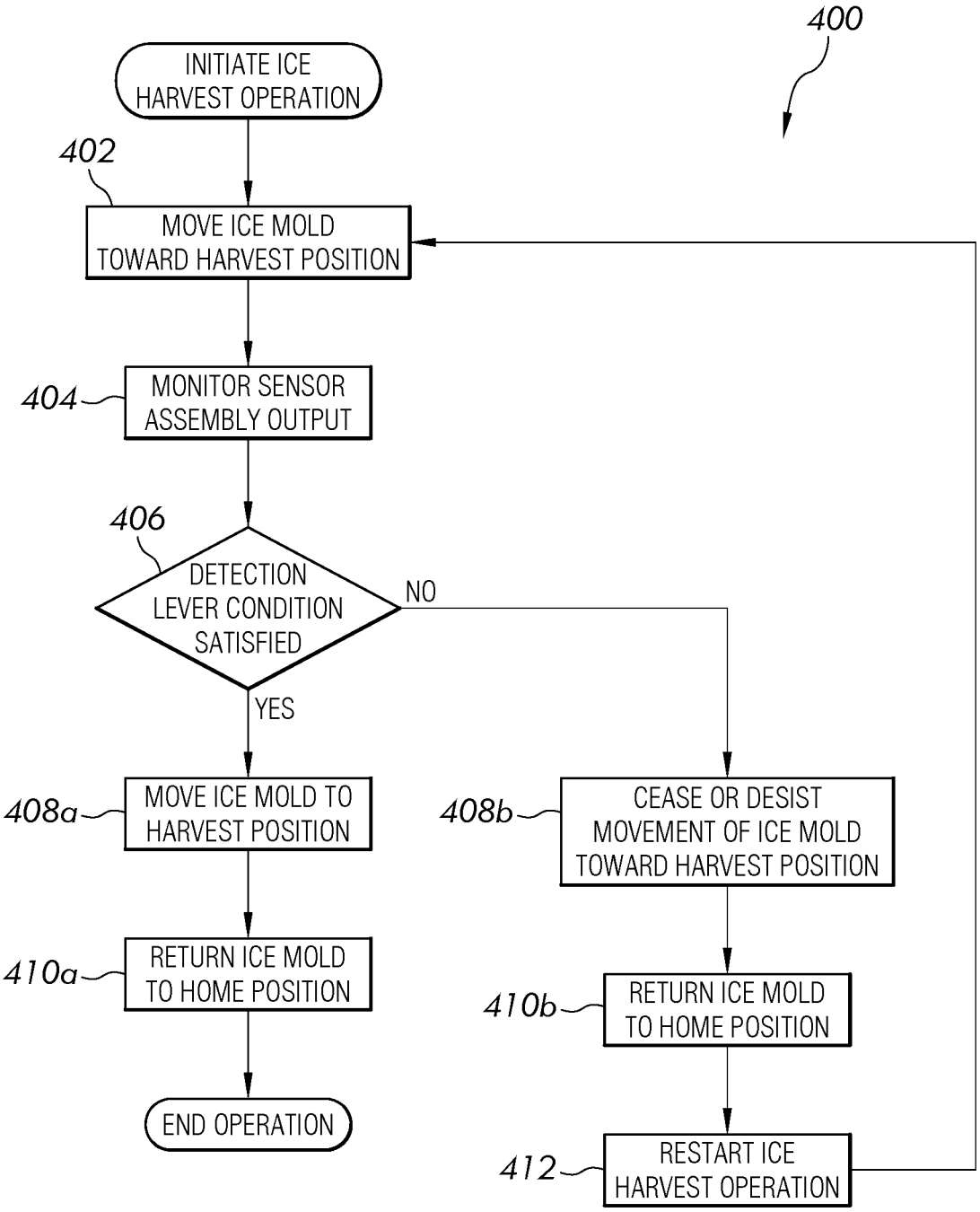
FIG. 13 schematically illustrates an example ice harvest operation for the ice maker.

The ice harvest operation 400 is shown in FIG. 13, and includes a moving step 402 that comprises moving the ice mold 14 from its home position toward its harvest position. The controller 92 can perform the moving step 402 by operating the motor 26 of the drive assembly 24 to move the ice mold 14 accordingly.

The moving step 402 will move the ice mold 14 toward the harvest position at a constant rate until the retention arm 66 of the ice maker 10 disengages from the detection lever 60 and releases the detection lever 60 from its influence, thereby allowing the detection lever 60 to properly indicate any need to harvest ice. Moreover, the moving step 402 will continue to move the ice mold 14 toward its harvest position until a later step in the ice harvest operation 400 takes over control of the ice mold's movement.

However, in some examples, the moving step 402 can cease movement either immediately or shortly after the detection lever 60 is released from the retention arm 66. For example, the moving step 402 can cease movement of the ice mold 14 once the ice mold 14 has moved a predetermined time and/or predetermined distance in which the detection lever 60 should be released from the retention arm 66. Moreover, in other examples, the moving step 402 will simply move the ice mold 14 a predetermined distance and/or predetermined time without any regard for the retention arm 66. In such examples, the moving step 402 can move the ice mold 14 completely to the harvest position or to an intermediate position between the home and harvest positions. The moving step 402 can move the ice mold 14 toward its harvest position in a variety of different manners without departing from the scope of the invention.

Depending on how much ice is currently stored below the ice mold 14, it may or may not be desirable to move the ice mold 14 completely to its harvest position, since harvesting further ice may be unnecessary and/or excessive. The ice harvest operation 400 therefore includes a monitoring step 404 and determining step 406 for determining whether the ice tray 14 should be moved to its harvest position.

More specifically, as discussed above, the sensor assembly 94 of the ice maker 10 is configured to detect a predetermined position (e.g., extended position or retracted position) of the detection lever 60 and send an output to the controller 92 indicating whether the detection lever 60 is in the predetermined position. Accordingly, the monitoring step 404 can include monitoring the output of the sensor assembly 94, and the determining step 406 can comprise determining whether a detection lever condition is satisfied during the monitoring step 404, wherein the detection lever condition requires that the output of the sensor assembly 94 indicates that the detection lever 60 assumes the predetermined position (e.g., extended position or retracted position) during the monitoring step 404. The controller 92 can perform the monitoring and determining steps 404, 406 accordingly.

In the present embodiment, the predetermined position corresponds to the extended position. Therefore, satisfaction of the detection lever condition in the determining step 406 will indicate that ice should be harvested and the ice tray 14 should be moved to its harvest position. Conversely, dissatisfaction of the detection lever condition will indicate that ice should not be harvested and the ice tray 14 should not be moved to the harvest position. However, in embodiments wherein the predetermined position corresponds to the retracted position, satisfaction of the detection lever condition in the determining step 406 will indicate that ice should not be harvested, and dissatisfaction of the detection lever condition will indicate that ice should be harvested.

The monitoring and determining steps 404, 406 can be initiated before, during, or after the moving step 402 described above. In the present embodiment, the monitoring step 404 is initiated immediately following initiation of the moving step 402, and will monitor the output of the sensor assembly 94 for a predetermined period of time to ensure that the ice mold 14 has moved a sufficient distance to release the detection lever 60 from the retention arm 66, and that the detection lever 60 has had an opportunity to gravitate to its extended position. However, in embodiments of the ice maker 10 that exclude the retention arm 66, the monitoring step 402 can be initiated at other times and can monitor the output for a shorter or earlier period of time.

The ice harvest operation 400 can further include at least one conditional step 408 controlling movement of the ice mold 14 based on the determining step 406. For example, the ice harvest operation 400 can include a first conditional step 408*a* of moving the ice mold 14 to its harvest position if the determining step 406 determines that the detection lever condition is satisfied during the monitoring step 404 (e.g., the detection lever 60 assumes the extended position indicating that ice should be harvested). Moreover, the ice harvest operation 400 can include a second conditional step 408*b* that ceases or desists movement of the ice mold 14 toward the harvest position if the determining step 406 determines that the detection lever condition is never satisfied during the monitoring step 404 (e.g., the detection lever 60 does not assume the extended position, indicating that ice should not be harvested).

The controller 92 can perform either of the first and second conditional steps 408*a*, 408*b* by controlling the motor 26 of the drive assembly 24 accordingly. That is, the controller 92 can perform the first conditional step 408*a* by operating the motor 26 to move the ice mold 14 in accordance with the first conditional step 408*a*. Moreover, the controller 92 can perform the second conditional step 408*b* by ceasing or desisting operation of the motor 26 in accordance with the second conditional step 408*b*.

As noted above, the moving step 402 in the present embodiment will move the ice mold 14 from its home position toward its harvest position at a constant rate until a later step in the ice harvest operation 400 takes over control of the ice mold's movement. Accordingly, initiation of the first conditional step 408*a* will maintain movement of the ice mold 14 until it assumes the harvest position. Meanwhile, initiation of the second conditional step 408*b* will cease movement of the ice mold 14 toward the harvest position. However, in embodiments wherein the moving step 402 moves the ice mold 14 to an intermediate position and then ceases moving the ice mold 14 prior to the first and second conditional steps 408*a*, 408*b*, initiation of the first conditional step 408*a* will resume movement of the ice mold 14 until it assumes the harvest position, and initiation of the second conditional step 408*b* will desist movement of the ice mold 14 toward the harvest position.

The ice harvest operation 400 can further include one or more returning steps 410 that move the ice mold 14 back to the home position in response to one of the conditional steps 408 described above. For example, the ice harvest operation 400 can include a first returning step 410*a* of moving the ice mold 14 from the harvest position back to the home position in response to completion of the first conditional step 408*a*, and a second returning step 410*b* of moving the ice mold 14 from its current position back to the home position in response to completion of the second conditional step 408*a*. The controller 92 can perform each of these steps by operating the motor 26 of the drive assembly 24 to move the ice mold 14 accordingly.

In cases where the second conditional step 408*b* is performed, the ice mold 14 will be returned to the home position by the second returning step 410*b* without ever reaching the harvest position. Thus, in some examples, the ice harvest operation 400 can include a restart step 412 that is performed in response to the second conditional step 410*b*, which will restart the ice harvest operation 400 at a later time to harvest any ice that is still present in the ice mold 14. In particular, the restart step 412 can restart the ice harvest operation 400 after a predetermined amount of time (e.g., between 30 and 90 minutes and preferably, about 60 minutes) following completion of the second returning step 410*b*. In examples with this restart step 412, the ice harvest operation 400 can be considered complete once it successfully moves the ice mold 14 to the harvest position via the first conditional step 408*a* and then returns the ice mold 14 to the home position via the first returning step 410*a*. However, in embodiments that exclude this restart step 412, the ice harvest operation 400 can be considered complete upon conclusion of the first returning step 410*a* or second returning step 410*b*.

The ice harvest operation 400 may comprise additional or alternative steps than those described above, and may exclude one or more of the steps described above. Indeed, in some examples, the ice harvest operation 400 may simply comprise moving the ice mold 14 from its home position toward/to the harvest position, without any further steps.

Figure 14:
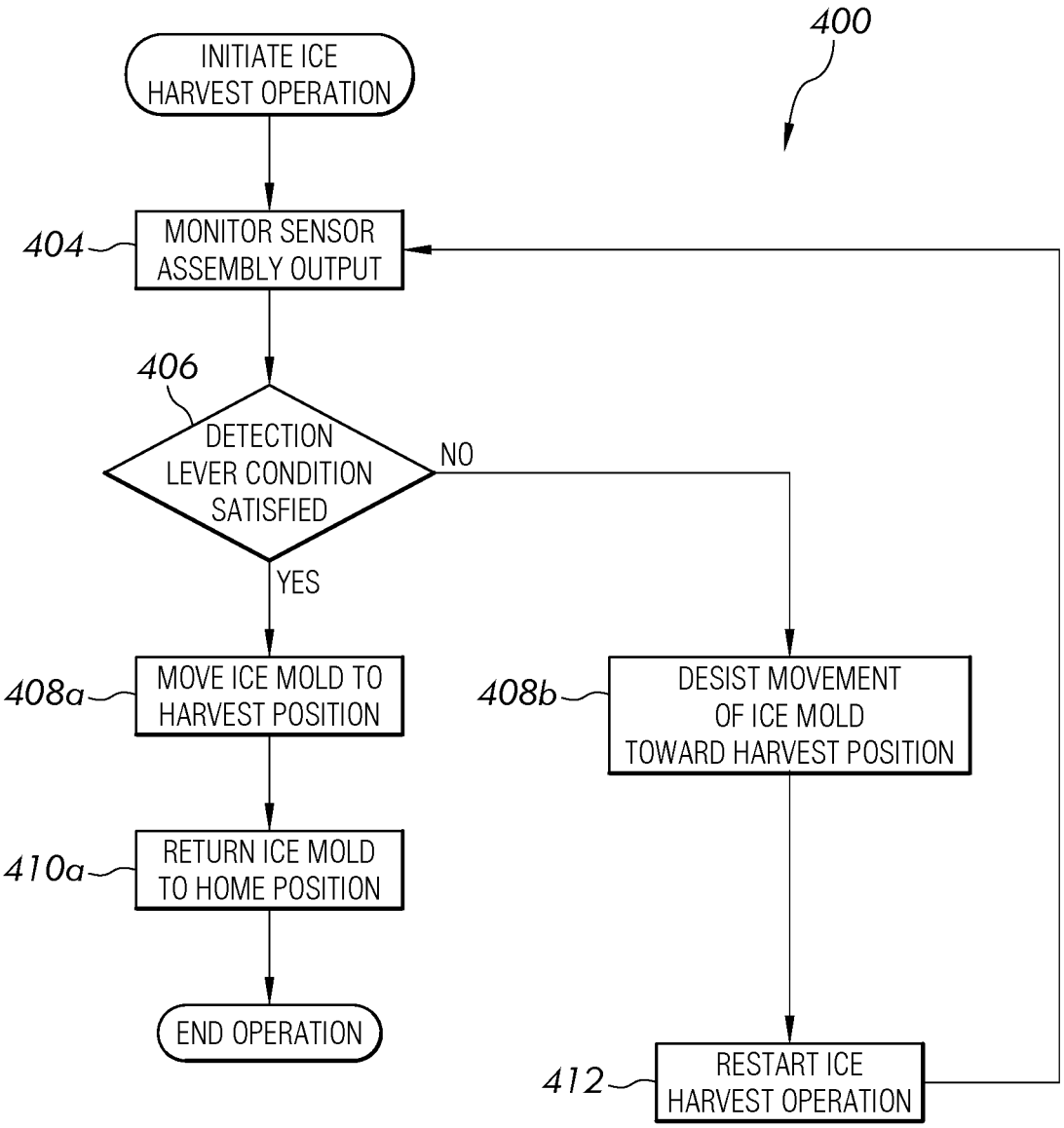
FIG. 14 schematically illustrates another example ice harvest operation for the ice maker.

For instance, one variation of the ice harvest operation 400 is illustrated in FIG. 14, which excludes the moving step 402 and second returning step 410*b*, but still includes the monitoring step 404, the determining step 406, the first and second conditional steps 408*a*, 408*b*, the first returning step 410*a*, and the restart step 412 described above. This variation of the ice harvest operation 400 can be used with embodiments of the ice maker 10 that exclude the retention arm 66, since the moving step 402 is not necessary to disengage the retention arm 66 from the detection lever 60 for the purposes of the determining step 406.

More specifically, the monitoring step 404 will monitor the output of the sensor assembly 94, and the determining step 406 will first determine whether the detection lever condition is satisfied (e.g., the detection lever 60 assumes the extended position indicating that ice should be harvested). If the detection lever condition is satisfied, the first conditional step 408*a* will move the ice mold 14 to its harvest position accordingly. In particular, the first conditional step 408*a* will move the ice mold 14 completely from the home position to the harvest position. The first returning step 410*a* will then return the ice mold 14 to its home position in response to completion of the first conditional step 408*a*.

If the detection lever condition is not satisfied, the second conditional step 408*b* will simply desist movement of the ice mold 14 toward the harvest position, thus maintaining the ice mold 14 in its home position. The restart step 412 will then restart the ice harvest operation 400 after a predetermined amount of time (e.g., between 30 and 90 minutes and preferably, about 60 minutes) following completion of the second conditional step 408*b*. The ice harvest operation 400 can be considered complete once it successfully moves the ice mold 14 to the harvest position via the first conditional step 408*a* and then returns the ice mold 14 to the home position via the first returning step 410*a*.

In some examples, the controller 92 can be configured to initiate the water fill operation 200 in response to completion of the ice harvest operation 400 discussed above, thereby restarting the main operating cycle of the ice maker 10. However, in other examples, the main operating cycle may terminate upon completion of the ice harvest operation 400.

D. Diagnostic Operation

Figure 15:
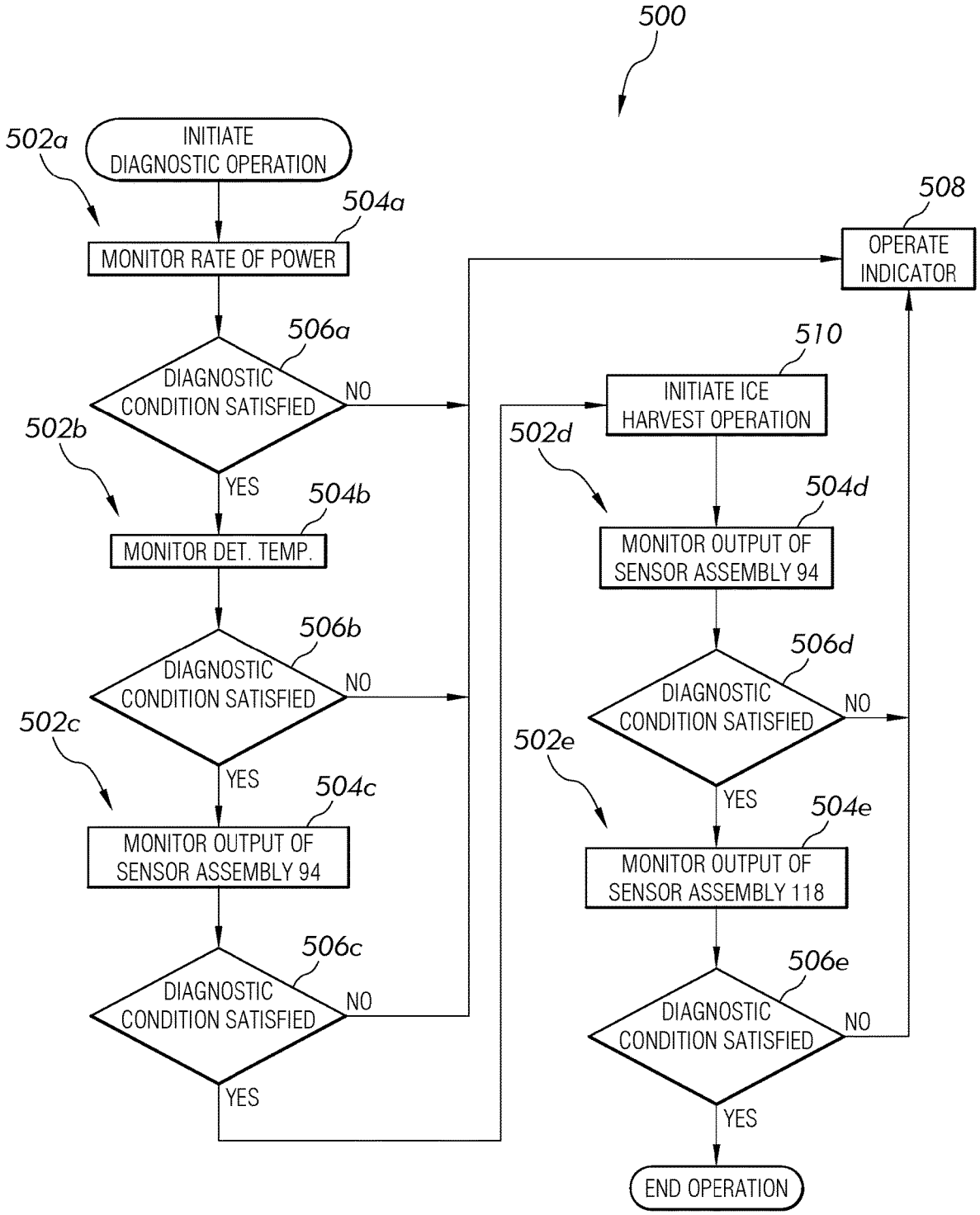
FIG. 15 schematically illustrates a diagnostic operation for the ice maker.

Turning to FIG. 15, the controller 92 can be configured to perform a diagnostic operation 500, which will diagnose one or more features of the ice maker 10. The diagnostic operation 500 is described below with respect to an embodiment of the ice maker 10 that is configured as shown in FIGS. 1-13. Moreover, the diagnostic operation 500 is initiated by pressing and holding the push-button 122 of the user interface 120 for a predetermined amount of time (e.g., 5 seconds) while the ice mold 14 is in its home position. However, it is to be appreciated that the diagnostic operation 500 or variations thereof may be used with other embodiments of the ice maker 10 as appropriate, and may be initiated differently in some embodiments, with or without the ice mold 14 in the home position.

The diagnostic operation 500 can include one or more diagnostic tests 502, wherein each diagnostic test 502 comprises a monitoring step 504 in which one or more parameters of the ice maker 10 are monitored, and a determining step 506 that determines if a diagnostic condition is satisfied during the monitoring step 504. Moreover, the diagnostic operation 500 can include an indicating step 508 of operating one or more indicators of the ice maker 10 based on the diagnostic test(s) 502.

For example, the diagnostic operation 500 can include a diagnostic test 502*a* having a monitoring step 504*a* and determining step 506*a* that can diagnose a water valve that is connected to the control line 134 of the ice maker's cable assembly 130.

More specifically, as discussed above, the control line 134 of the ice maker's cable assembly 130 can be connected to a water valve of an appliance, and the controller 92 can selectively provide a control signal (e.g., positive or zero voltage) to the control line 134 to open and close the valve accordingly. For instance, in some examples, the water valve will normally be closed and the controller 92 can selectively provide a positive voltage to the control line 134 to open the valve. In other examples, the water valve will normally be open and the controller 92 can selectively provide a positive voltage to the output to close the valve. In either case, the water valve should draw power through the control line 134 when a positive voltage is applied to the control line 134.

With this understanding, the monitoring step 504*a* comprises monitoring a rate of power drawn through the control line 134 while a positive voltage (e.g., 85-265 VAC at 50-60 Hz) is applied to the control line 134 for a predetermined amount of time. The controller 92 can perform this step 504*a* by selectively providing the positive voltage to the control line 134 and monitoring the rate of power accordingly. Meanwhile, the determining step 506*a* determines if a diagnostic condition is satisfied during the monitoring step 504*a*, wherein the diagnostic condition requires that the rate of power realized during the monitoring step 504*a* is within a predetermined range of power (e.g., 85-265 VAC at 50-60 Hz). The controller 92 can also perform this step with its internal logic.

Satisfaction of the diagnostic condition in the determining step 506*a* will suggest that the water valve is properly connected to the control line 134 and drawing power from the controller 92 when voltage is applied to the control line 134. Conversely, dissatisfaction of the diagnostic condition will suggest that the water valve is malfunctioning and/or disconnected from the controller 92.

The diagnostic operation 500 can further include a diagnostic test 502*b* having a monitoring step 504*b* and determining step 506*b* that can diagnose the temperature sensor 104 of the ice maker 10 and determine if the temperature sensor 104 is properly detecting temperature and communicating that temperature to the controller 92.

More specifically, the monitoring step 504*b* is intended to be performed while the temperature sensor 104 is in an environment having a temperature within a predetermined range of temperatures (e.g., preferably between −50° C. and +55° C. and more preferably between −35° C. and +40° C.). The diagnostic operation 500 can simply assume that the temperature sensor 104 is in such an environment, without any additional verification. However, to help ensure that the temperature sensor 104 is in such an environment during the monitoring step 504*b*, a manual of the ice maker 10 can explain that the diagnostic test 500 should be performed while the temperature sensor 104 is in an environment having a temperature within the intended predetermined range of temperatures.

Assuming that the temperature sensor 104 is in its intended environment, the monitoring step 504*b* comprises monitoring the temperature detected by the temperature sensor 104 (e.g., the resistance of the temperature sensor 104, which corresponds to its temperature). Meanwhile, the determining step 506*b* determines if a diagnostic condition is satisfied during the monitoring step 504*b*, wherein the diagnostic condition requires that the temperature sensor detects a temperature during the monitoring step 504*b* that is within the predetermined range of temperatures of the intended environment. The controller 92 will perform these steps by monitoring the temperature detected by the temperature sensor 104 and determining if the diagnostic condition is satisfied accordingly.

Satisfaction of the diagnostic condition in the determining step 506*b* will suggest that the temperature sensor 104 is properly detecting temperature and communicating that temperature to the controller 92. Conversely, dissatisfaction of the diagnostic condition will suggest that the temperature sensor 104 is malfunctioning and/or not communicating properly with the controller 92.

The diagnostic operation 500 can further include a diagnostic test 502*c* having a monitoring step 504*c* and determining step 506*c* that can diagnose the sensor assembly 94. As noted above, the sensor assembly 94 is configured to detect a predetermined position (e.g., the extended position or retracted position) of the detection lever 60 and provide an output (i.e., positive signal or zero signal) to the controller 92 indicating whether the detection lever 60 is in the predetermined position. Accordingly, the diagnostic test 502*c* is specifically designed to diagnose whether the sensor assembly 94 properly indicates that the detection lever 60 is not in the predetermined position.

More specifically, in the present embodiment, the predetermined position corresponds to the extended position, and the sensor assembly 94 is configured to provide a zero signal to the controller 92 whenever the detection lever 60 is not in the predetermined position. Moreover, the diagnostic test 502*c* is performed while the ice mold 14 is in its home position and the retention arm 66 is retaining the detection lever 60 in the retracted position. Accordingly, the sensor assembly 94 should provide a zero signal indicating that the detection lever 60 is not in the predetermined position. With this understanding, the monitoring step 504*c* comprises monitoring the output of the sensor assembly 94. Meanwhile, the determining step 506*c* determines if a diagnostic condition is satisfied during the monitoring step 504*c*, wherein the diagnostic condition requires that the output of the sensor assembly 94 monitored during the monitoring step 504*c* indicates that the detection lever 60 never assumes the predetermined position (i.e., a zero signal) during the monitoring step 504*c*. The controller 92 will perform these steps by monitoring the output of the sensor assembly 94 to the controller 92, and determining if the diagnostic condition is satisfied accordingly.

Satisfaction of the diagnostic condition in the determining step 506*c* will suggest that the sensor assembly 94 is properly detecting when the detection lever 60 is in the predetermined position and communicating the absence of that condition to the controller 92. Conversely, dissatisfaction of the diagnostic condition will suggest that the sensor assembly 94 is malfunctioning and/or not communicating properly with the controller 92.

The diagnostic test 502*c* can include additional and/or alternative steps in other embodiments. For example, if the ice maker 10 does not include a retention mechanism that retains the detection lever 60 in the retracted position during the monitoring step 504*c*, the diagnostic test 502*c* may require that a user physically retains the detection lever 60 in the retracted position during the monitoring step 504*c*. As another example, if the predetermined position detected by the sensor assembly 94 corresponds to the retracted position of the detection lever 60, the diagnostic test 502*c* may require that the ice mold 14 is moved toward the harvest position in order to release the detection lever 60 to the extended position, so that the diagnostic test 502*c* can diagnose whether the sensor assembly 94 properly indicates that the detection lever 60 is not in the retracted position.

The diagnostic operation 500 can further include an initiating step 510 of initiating the ice harvest operation 400 in FIG. 13. Initiation of the ice harvest operation 400 can facilitate later steps of the diagnostic operation, as discussed below.

More specifically, upon initiation of the ice harvest operation 400, the moving step 202 of the ice harvest operation 400 will move the ice mold 14 from the home position toward the harvest position as discussed above, thereby releasing the detection lever 60 from the retention arm 66 and permitting the detection lever 60 to gravitate towards its extended position. The diagnostic operation 500 will then proceed under the assumption that the detection lever 60 assumes the extended position. To help ensure this, a manual of the ice maker 10 can explain that the ice maker 10 should be free of external obstruction (e.g., ice buildup) during the diagnostic operation 500 that would inhibit the detection lever 60 from assuming its extended position.

As noted above, the sensor assembly 94 is configured to detect a predetermined position (i.e., the extended position or retracted position) of the detection lever 60 and provide an output (i.e., positive signal or zero signal) to the controller 92 indicating whether the detection lever 60 is in the predetermined position. In particular, the predetermined position in the present embodiment corresponds to the extended position, and the sensor assembly 94 is configured to provide a positive signal to the controller 92 whenever the detection lever 60 is in the predetermined position. Understanding that the detection lever 60 should assume the extended position after initiation of the ice harvest operation 400, the diagnostic operation 500 can include a diagnostic test 502*d* having a monitoring step 504*d* and a determining step 506*d* that can diagnose whether the sensor assembly 94 properly indicates that the detection lever 60 assumes the extended position during the monitoring step 504*d*.

The monitoring step 504*d* can be executed after the moving step 402 of the ice harvest operation 400 has released the detection lever 60, and comprises monitoring the output of the sensor assembly 94. Meanwhile, the determining step 506*d* determines if a diagnostic condition is satisfied during the monitoring step 504*d*, wherein the diagnostic condition requires that the output of the sensor assembly 94 monitored during the monitoring step 504*d* indicates that the detection lever 60 assumes the predetermined position during the monitoring step 504*d* (i.e., a positive signal). The controller 92 will perform these steps by monitoring the output of the sensor assembly 94 to the controller 92, and determining if the diagnostic condition is satisfied accordingly.

Satisfaction of the diagnostic condition in the determining step 506*d* will suggest that the sensor assembly 94 is properly detecting when the detection lever 60 is in the predetermined position and communicating that condition to the controller 92. Conversely, dissatisfaction of the diagnostic condition will suggest that the sensor assembly 94 is malfunctioning and/or not communicating properly with the controller 92.

The diagnostic test 502*d* can include additional and/or alternative steps in other embodiments. For example, if the predetermined position detected by the sensor assembly 94 corresponds to the retracted position of the detection lever 60, the diagnostic test 502*d* may be performed before or without the initiation step 510. Similarly, if the predetermined position corresponds to the extended position but the ice maker 10 does not include a retention mechanism that normally retains the detection lever 60 in the retracted position, the diagnostic test 502*d* could be performed before or without the initiation step 510.

The diagnostic operation 500 can further include a diagnostic test 502*e* having a monitoring step 504*e* and a determining step 506*e* that can diagnose the rotation of the ice mold 14 during the ice harvest operation 400 initiated by the initiating step 510, and make sure that the ice mold 14 properly rotates by a predetermined time.

More specifically, as noted above, the detection lever 60 should assume the extended position after the ice harvest operation 400 is initiated by the initiating step 510 and the moving step 402 releases the detection lever 60 from the retention arm 66. Accordingly, the ice harvest operation 400 should perform the first conditional step 408*a* and complete movement of the ice mold 14 to its harvest position.

With this understanding, the monitoring step 504*e* can be executed in response to initiation of the ice harvest operation 400, and comprises monitoring the output of the sensor assembly 118 during the ice harvest operation 400, which will indicate the position of the ice mold 14. Meanwhile, the determining step 506*e* determines if a diagnostic condition is satisfied during the monitoring step 504*e*, wherein the diagnostic condition requires that the ice mold 14 moves from the home position to the harvest position before a predetermined time. The controller 92 will perform these steps by monitoring the output of the sensor assembly 94 to the controller 92, and determining if the diagnostic condition is satisfied accordingly. Moreover, the predetermined time can be set as a certain time (e.g., 10 seconds) after initiation of the ice harvest operation 400, initiation of the moving step 402 of the ice harvest operation 400, or initiation of the determining step 406 of the ice harvest operation 400.

Satisfaction of the diagnostic condition in the determining step 506*e* will suggest that the ice mold 14 is properly rotating during the ice harvest operation 400 and the sensor assembly 118 is properly communicating with the controller 92. Conversely, dissatisfaction of the diagnostic condition will suggest that the ice mold 14 is not rotating properly and/or the sensor assembly 118 is malfunctioning.

As noted above, the diagnostic operation 500 can include an indicating step 508 of operating one or more indicators of the ice maker 10 based on its diagnostic test(s) 502. For example, the indicating step 508 in the present embodiment will activate the light module 124 described above to provide an indication if any one of the determining steps 506 determines that its diagnostic condition is not satisfied. More specifically, the indicating step 508 will activate the light module 124 if a) the determining step 506*a* determines that its diagnostic condition is never satisfied during the monitoring step 504*a*; b) the determining step 506*b* determines that its diagnostic condition is never satisfied during the monitoring step 504*b*; c) the determining step 506*c* determines that its diagnostic condition is not satisfied during the monitoring step 504*c, d*) the determining step 506*d* determines that its diagnostic condition is never satisfied during the monitoring step 504*d*; or e) the determining step 506*e* determines that its diagnostic condition is never satisfied during the monitoring step 504*e*.

The indicating step 508 will activate the light module 124 such that the light module 124 blinks persistently until the ice maker 10 is turned off, thereby indicating to a user that a diagnostic condition has not been satisfied and the ice maker 10 is not operating properly. However, in some examples, the light module 124 may blink for a predetermined number of times, or be persistently lit until the ice maker 10 is turned off. Moreover, in some examples, the indicating step 508 may activate the light module 124 differently depending on which diagnostic condition is not satisfied. For instance, the indicating step 508 may activate the light module 124 to blink different colors and/or a different number of times based on which diagnostic condition is not satisfied.

The indicating step 508 can operate any indicator (e.g., light module, speaker, display) of the ice maker 10 in a variety of different manners if one or more of the determining steps 506 determines that its diagnostic condition is not satisfied. Moreover, in some examples, the indicating step 508 may operate an indicator only when multiple (e.g., all) determining steps 506 determine that their diagnostic conditions are not satisfied.

If none of the determining steps 506 determines that its diagnostic condition is not satisfied, this will indicate that the ice maker 10 is operating properly and the diagnostic operation 500 can be considered complete. In some cases, the controller 92 may be configured to return the ice maker 10 to its main operating cycle (e.g., the water filling operation 200) upon completion of the diagnostic operation 500. Conversely, if during the diagnostic operation 500 one of the determining steps 506 determines that its diagnostic condition is not satisfied, the indicating step 508 will operate an indicator as discussed above and the controller 92 can cease performing any further steps in the diagnostic operation 500. In such cases, power can be cycled to the ice maker 10 to restart the ice maker 10.

Various operations of the ice maker 10 have been described above. It is to be appreciated that each operation can comprise additional and/or alternative steps than those described above, and can exclude one or more of the steps described above.

Some steps in operations of the ice maker 10 are described and claimed herein as performing a certain action "if" a certain condition occurs or "in response to" a certain condition, wherein the condition comprises one or more terms. Such a conditional action as described and claimed herein means that performance of the action is conditional on the existence of its corresponding condition, rather than incidental with the existence of its corresponding condition. Moreover, the corresponding condition is open-ended, meaning that the corresponding condition may include additional terms than those described and claimed. Still further, there may be separate steps that perform the same action, either conditionally or non-conditionally. For example, a conditional step of performing action X "if" or "in response to" condition Y requiring term Z means that performance of action X is conditional on the existence of condition Y, and that condition Y may require one or more terms in addition to term Z. Moreover, there may be a separate step that performs action X, either conditionally or non-conditionally.

IX. Additional Features

Figure 16:
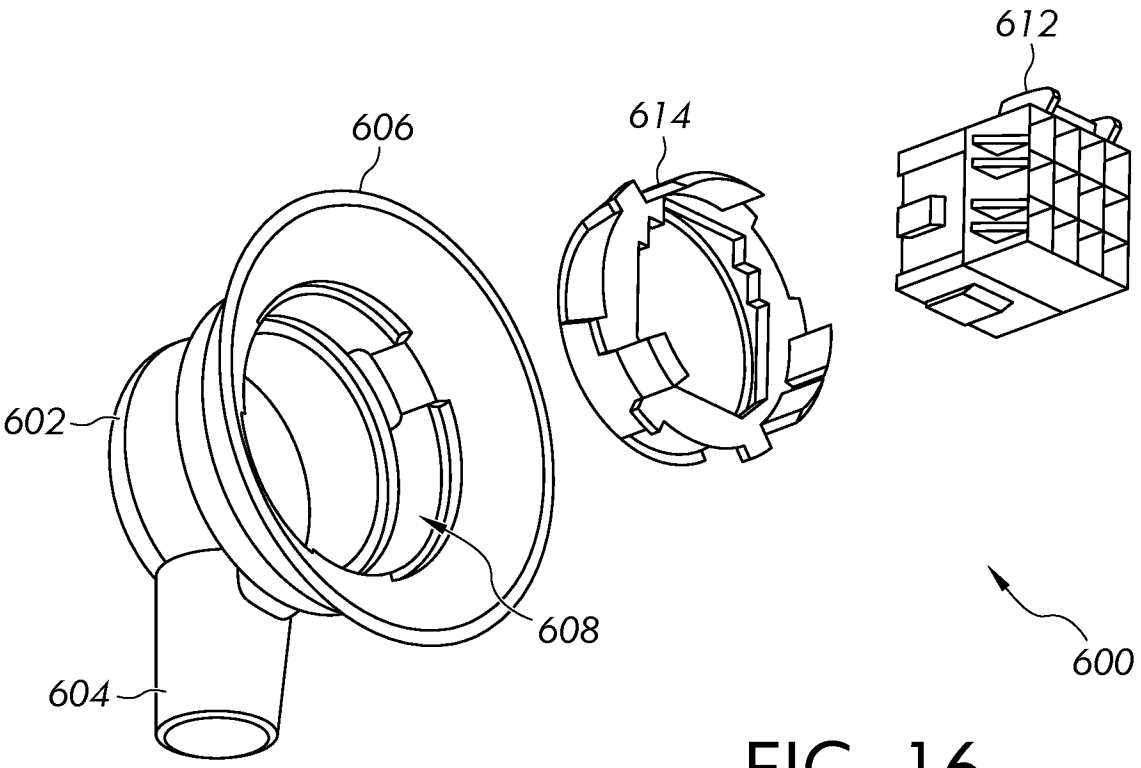
FIG. 16 is an exploded view of an example grommet assembly for a refrigerator.

Additional features for a refrigerator will now be described that can be implemented with or without the ice maker 10 described above. For example, as shown in FIG. 16, a grommet assembly 600 is illustrated for feeding electrical wiring through a wall (e.g., compartment liner) of a refrigerator. The grommet assembly 600 includes a grommet body 602 that is a tubular body having a first end 604 and a second end 606, wherein a channel 608 extends through the grommet body 602 from the first end 604 to the second 606. The grommet body 602 has an elbow, and increases in diameter from the first end 604 to the second end 606.

The grommet body 602 can be installed in a wall of a refrigerator by inserting the first end 604 into an aperture in the wall that is smaller in diameter than the second end 606 of the grommet body 602. In particular, the first end 604 of the grommet body 602 can be inserted into the aperture until a rear face of the second end 60 abuts against the wall surrounding the aperture, thereby preventing further insertion of the grommet body 602. The grommet body 602 can be fixed to the wall in this inserted position using a snap-fit connection, adhesive, or other fastening means for fixing two components to each other.

Electrical wiring from various features of the appliance can be fed through the channel 608 of the grommet body 602 and connected to a common connector 612. For example, the connector 612 can correspond to the connector 140 of the ice maker 10 described above, and wiring from an AC power inlet (e.g., AC power inlet 170) and water valve (e.g., water valve 174) can be fed through the channel 608 of the grommet body 602 and connected to the connector 612. Moreover, the grommet assembly 600 can include an adapter member 614 that enables the connector 612 to be secured within the second 606 of the grommet body 602. In particular, the adapter member 614 can be removably connected within the second 606 of the grommet body 602 (e.g., using a snap-fit), and the connector 612 can be removably connected within the adapter member 614 (e.g., using another snap-fit).

By way of the design above, different connectors can be secured within the second 606 of the grommet body 602 using different adapter members 614. In this manner, the same grommet body 602 can be universally manufactured and installed for different applications having different types of connectors.

Figure 18A:
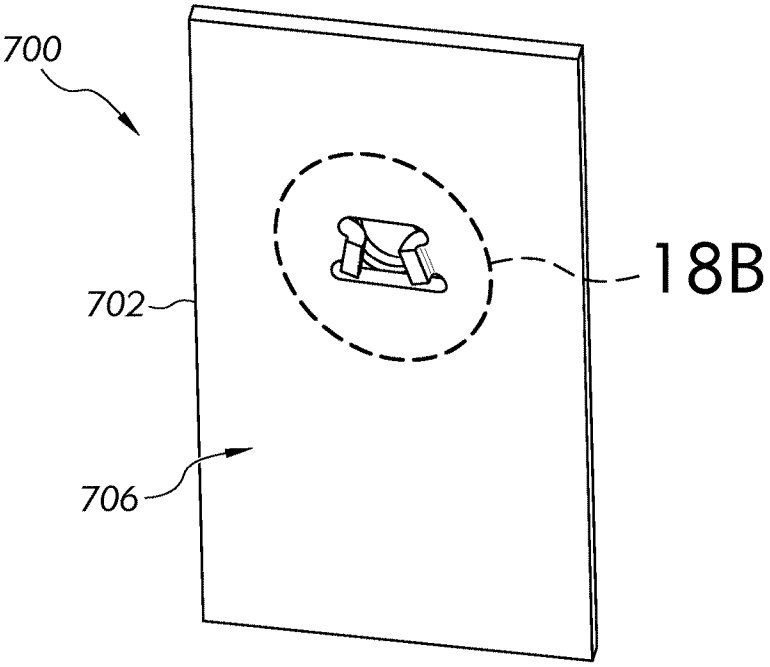
FIG. 18A is a second perspective of the anchor nut in FIG. 17.
Figure 18B:
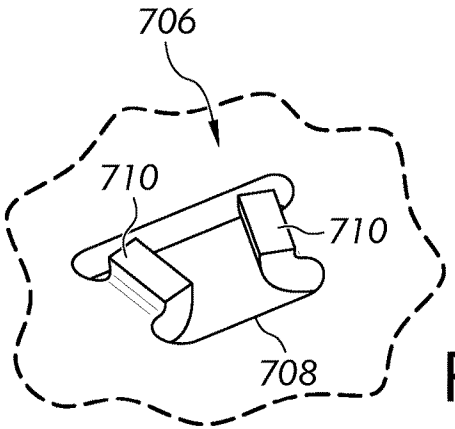
FIG. 18B is a close-up view of the section 18B in FIG. 18A.
Figure 17:
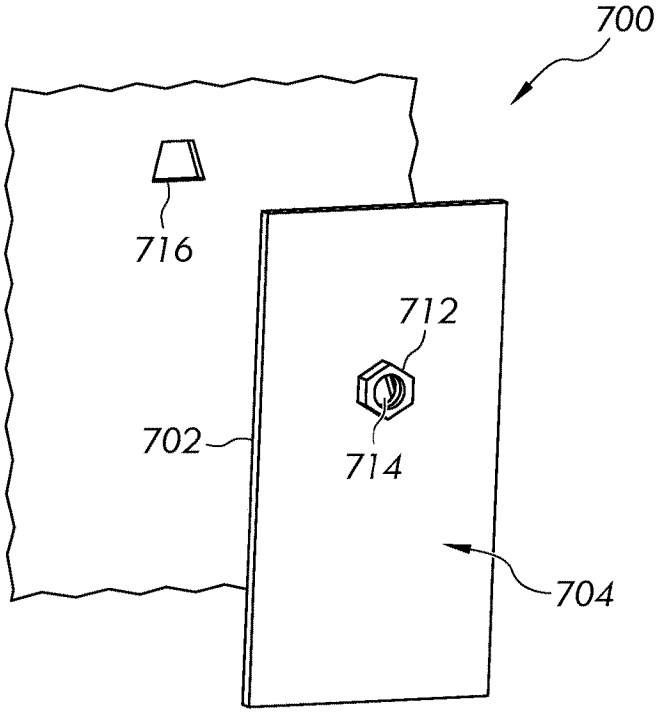
FIG. 17 is a first perspective of an example anchor nut for a refrigerator.

Turning to FIGS. 17, 18A, and 18B, an anchor nut 700 is illustrated for attaching various features (e.g., door handle) to a wall (e.g., door panel) of a refrigerator. The anchor nut 700 includes a base plate 702 having a first side 704, a second side 706, and a plate aperture 708 extending through the base plate 702. The base plate 702 further has a pair of wings 710 extending from the second side 706 of the base plate 702 on opposite sides of the plate aperture 708. These wings 710 can be formed when the first side 704 of the base plate 702 is punched to form the plate aperture 708. Moreover, the wings 710 are non-parallel such that the wings 710 are closer to each other at one end than another.

The anchor nut 700 further includes a fastener member 712 having a fastener aperture 714 extending therethrough that is threaded. The fastener member 712 is fixed to (e.g., welded to or integrally formed with) the first side 704 of the base plate 702 such that the plate aperture 708 and the fastener aperture 714 are aligned. In the present embodiment, the fastener member 712 is a hex-nut.

To install the anchor nut 702 onto a wall (e.g., door panel) of a refrigerator, the wall can be provided with an aperture 716 that is trapezoidal in shape, and the second side 706 of the base plate 702 can be placed against the wall such that the wings 710 of the base plate 702 extend into the trapezoidal aperture 716 and engage the side edges of the trapezoidal aperture. In this manner, the wings 710 will be fixed in position and prevented from rotating within the trapezoidal aperture 716. Moreover, the trapezoidal shape of the aperture 716 ensures that the anchor nut 702 is properly oriented (e.g., upright) so that the wings 710 of the base plate 702 extend properly into the trapezoidal aperture 716. Once the anchor nut 700 is installed on the wall, another feature (e.g., door handle) on an opposite side of the wall can be fixed to the wall by passing a threaded fastener through the trapezoidal aperture 716 and threadably securing the threaded fastener to the fastener member 712 of the anchor nut 702.

Figure 19:
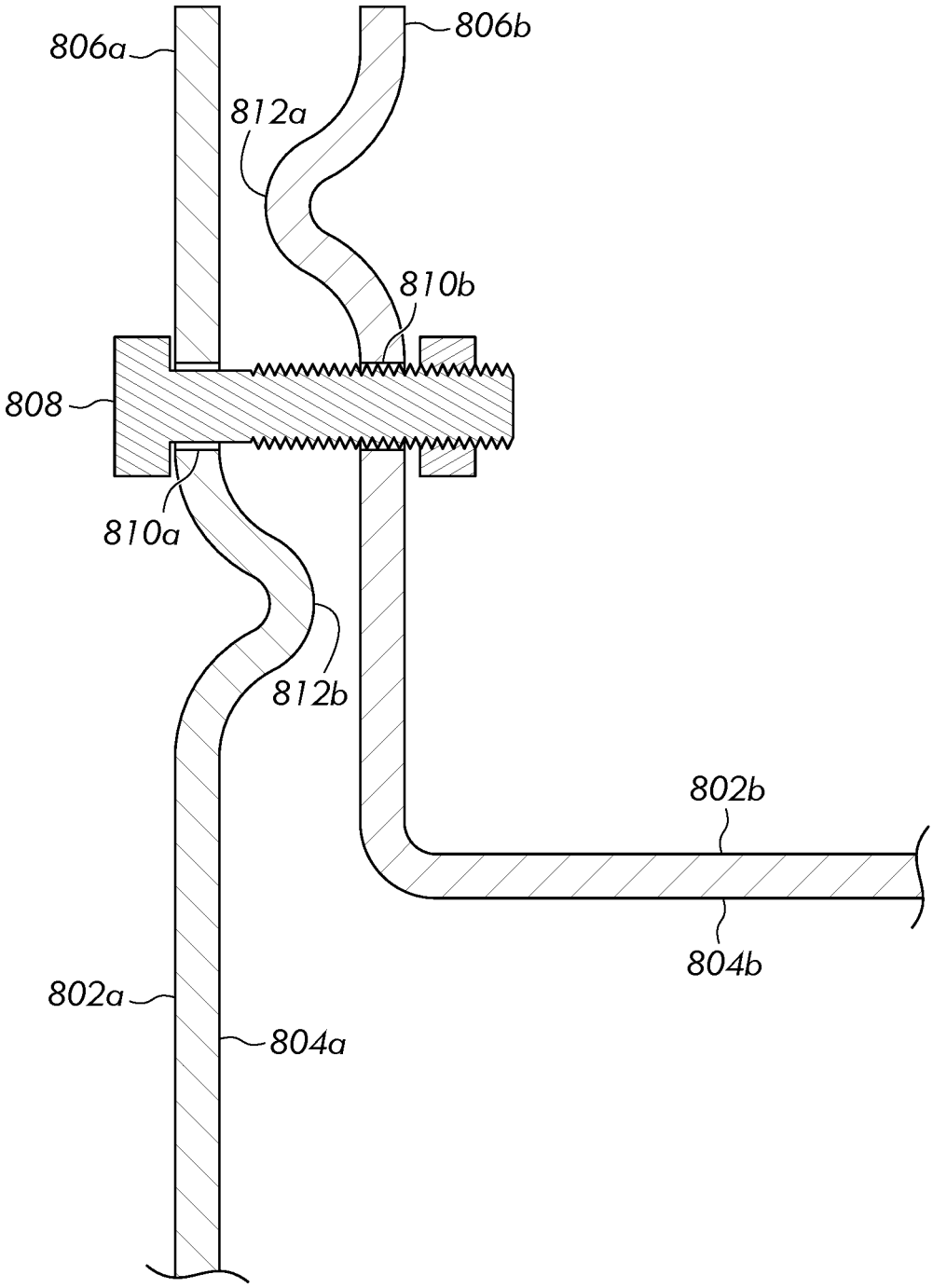
FIG. 19 is a cross-section view of an example configuration for joining two pieces of sheet metal for a refrigerator.

Turning to FIG. 19, a configuration for joining two pieces of sheet metal for a refrigerator will now be described. Separate pieces of sheet metal are often joined to form various structures of a refrigerator such as, for example, an outer shell of the refrigerator cabinet or the cover of a machine compartment for the refrigerator. Moreover, the structures formed by such sheet metal are often designed to contain foam insulation for insulating the compartment(s) of the refrigerator. However, due to the wavy nature of thin sheet metal, the seam between two pieces of sheet metal can have gaps that permit foam insulation to seep through, particularly during a curing process of the foam.

Accordingly, FIG. 19 is a cross-section view illustrating a first piece of sheet metal 802*a* having a main portion 804*a* and a flange portion 806*a*, and a second piece of sheet metal 802*b* having a main portion 804*b* and a flange portion 806*b*. The pieces of sheet metal 802*a*, 802*b* are arranged such that their flange portions 806*a*, 806*b* are substantially parallel to and face each other, while their main portions 804*a*, 804*b* are substantially perpendicular to each other. However, the main portions 804*a*, 804*b* may be parallel or oblique to each other in other examples.

The pieces of sheet metal 802*a*, 802*b* are joined with one or more fasteners 808 that extend through corresponding apertures 810*a*, 810*b* in their flange portions 806*a*, 806*b*, although other forms of attachment are possible in other embodiments (e.g., welding). Moreover, each flange portion 806*a*, 806*b* has an embossment 812*a*, 812*b* that projects toward the other flange portion 806*a*, 806*b* and extends the length of the flange portion 806*a*, 806*b* (the length extending along the viewing direction in FIG. 19). The embossments 812*a*, 812*b* are offset such that they are on opposite sides of the fastener(s) 808 joining the pieces of sheet metal 802*a*, 802*b*. In this manner, the embossments 812*a*, 812*b* will inhibit foam insulation from seeping through the seam between the pieces of sheet metal 802*a*, 802*b*.

Figure 20:
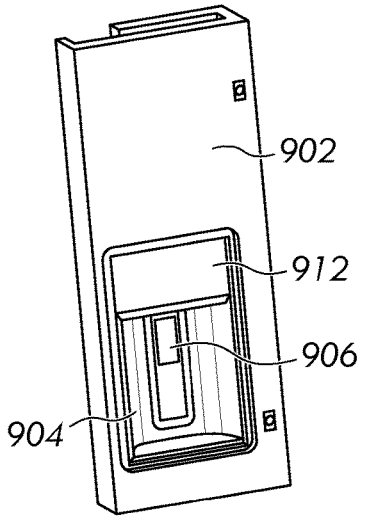
FIG. 20 is a perspective view of a door for a refrigerator.
Figure 21:
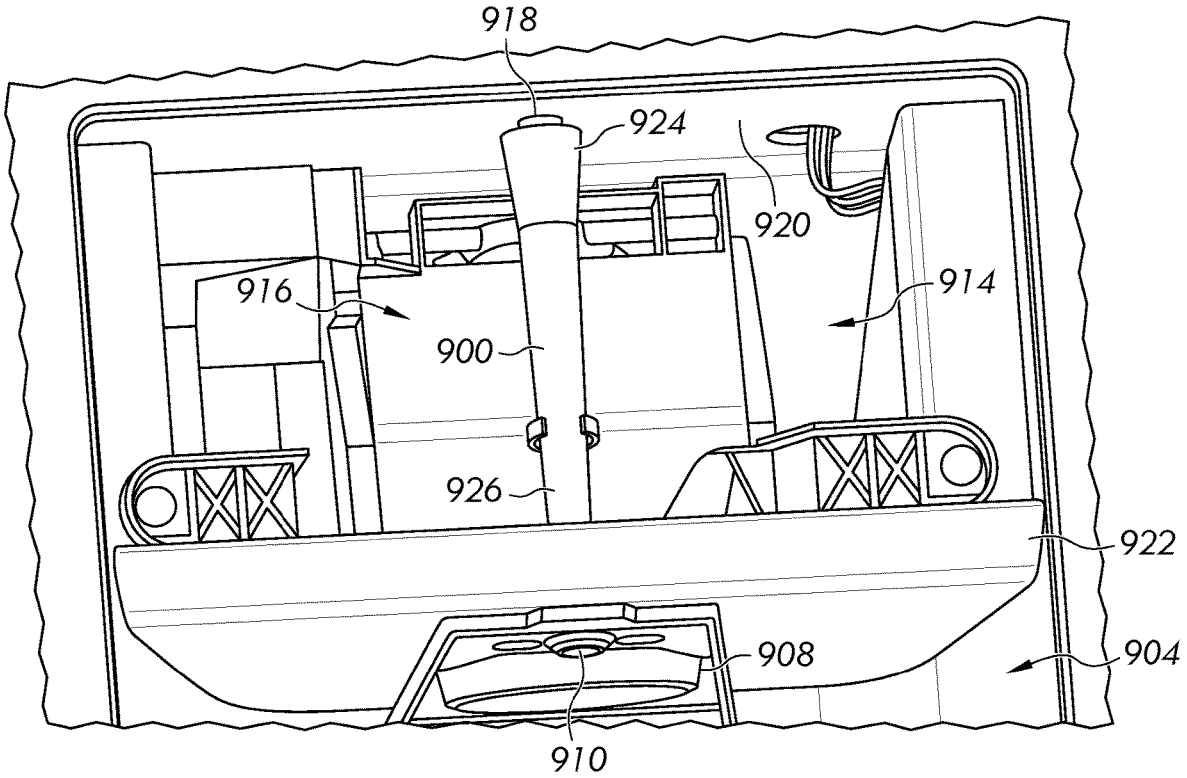
FIG. 21 is a close-up view of the door in FIG. 20, with a user interface of the door removed.

Turning to FIGS. 20 & 21, a water tube guide 900 is illustrated for guiding a water line through a door 902 of a refrigerator. The door 902 includes a dispenser pocket 904 and one or more actuators 906 (e.g. paddles, buttons, etc.) that can be actuated to dispense water or ice in the dispenser pocket 904. In particular, ice and water can be dispensed respectively through an ice chute 908 and a water outlet 910 located at the top of the dispenser pocket 904. The door 902 further includes a user interface 912 above the dispenser pocket 904, and an apparatus compartment 914 located within the door 902 behind the user interface 912 that contains various dispensing apparatus 916 (e.g., ice dispensing machinery).

Typically, a water line is fed from the refrigerator cabinet through the door 902 to its water outlet 910. In particular, the water line can be fed through a hole 918 in an upper wall 920 of the apparatus compartment 914, then through a space between the user interface 912 and dispensing apparatus 916, and then through a lower wall 922 of the apparatus compartment 914 to the water outlet 910. However, it can be difficult to feed the water line back through the space between the user interface 912 and dispensing apparatus 916 without having to remove the user interface 910.

Accordingly, the water tube guide 900 is a tapered tube that is arranged within the apparatus compartment 914 between the user interface 912 and dispensing apparatus 916, and is aligned with the water outlet 910 and the hole 918 in the upper wall 920 of the apparatus compartment 914. The water line can be through the water tube guide 900 to guide the water line through the space between the user interface 912 and dispensing apparatus 916 to the water outlet 910. In particular, the water line can be fed through the hole 918 in the upper wall 920 of the apparatus compartment 914 into a top portion 924 of the water tube guide 900, then through the water tube guide 900 toward a bottom portion 926 of the water tube guide 900. The top portion 924 is relatively large to facilitate insertion of the water line into the water tube guide 900, while the bottom portion 926 is relatively narrow so that the water line aligns with the water outlet 910 when located in the bottom portion 926. The water tube guide 900 can therefore facilitate installation of the water line within the door 902.

Moreover, in some cases, the upper and bottom portions 924, 926 of the water tube guide 900 can abut and be sealed against the upper and bottom walls 920, 922 of the apparatus compartment 914 to create a closed environment within the water tube guide 900 that prevents contamination of water passing through the water tube guide 900.

This application has been described with reference to the example embodiments described above. Modifications and alterations will occur to others upon a reading and understanding of this specification. Examples embodiments incorporating one or more aspects of the invention are intended to include all such modifications and alterations insofar as they come within the scope of the appended claims.

What is claimed is:

1. An ice maker comprising:

a carriage;

an ice mold defining a plurality of cavities that is movably coupled to the carriage such that the ice mold is movable relative to the carriage between a home position and a harvest position;

a detection lever movably coupled to the carriage such that the detection lever is movable between a retracted position and an extended position, the detection member being biased toward the extended position; and a retention mechanism configured to retain the detection lever in the retracted position when the ice mold is in the harvest position, wherein the retention mechanism is configured to retain the detection lever in the retracted position when the ice mold is in the home position, and release the detection lever when the ice mold is moved from the home position to the harvest position.

2. The ice maker according to claim 1, wherein:

the ice mold has a first end portion rotatable supported by a first portion of the carriage and a second end portion rotatably supported by a second portion of the carriage; and the carriage supports the ice mold, detection lever, and retention mechanism.

3. The ice maker according to claim 1, wherein the retention mechanism includes a retention lever rotatably coupled to the carriage and an actuation member fixed to the ice mold that are configured to retain the detection lever in the retracted position when the ice mold is in the harvest position.

4. The ice maker according to claim 3, wherein the actuation member is configured to engage the retention lever as the ice mold is moved from the home position to the harvest position, causing the retention lever to rotate until the ice mold assumes the harvest position and the retention lever retains the detection lever in the retracted position.

5. The ice maker according to claim 1, wherein the retention mechanism includes a retention arm fixed to the ice mold that is configured to retain the detection lever in the retracted position when the ice mold is in the home position.

6. The ice maker according to claim 5, wherein: the retention arm is configured to engage the detection lever when the ice mold is in the home position and retain the detection lever in the retracted position, the retention arm is configured to disengage from the detection lever when the ice mold is moved from the home position to the harvest position, and the retention arm is configured to re-engage the detection lever when the ice mold is moved from the harvest position back to the home position.

7. The ice maker according to claim 1, wherein the ice maker includes a spring configured to bias the detection lever towards the extended position.

8. An ice maker comprising:

a carriage;

an ice mold defining a plurality of cavities that is movably coupled to the carriage such that the ice mold is movable relative to the carriage between a home position and a harvest position;

a detection lever movably coupled to the carriage such that the detection lever is movable between a retracted position and an extended position, the detection member being biased toward the extended position; and a retention mechanism configured to retain the detection lever in the retracted position when the ice mold is in the harvest position, wherein the retention mechanism is configured to retain the detection lever in the retracted position when the ice mold is in the home position, and release the detection lever when the ice mold is moved from the home position to the harvest position, and wherein the ice maker comprises a drive arm configured to exert force on the detection lever toward the extended position as the ice mold is moved from the home position to the harvest position if the detection lever remains in the retracted position upon release from the retention mechanism.

9. The ice maker according to claim 8, wherein:

the retention mechanism includes a retention arm fixed to the ice mold that is configured to retain the detection lever in the retracted position when the ice mold is in the home position, and the drive arm corresponds to the retention arm.

10. The ice maker according to claim 1, further comprising a self-contained control system comprising a controller and a non-contact sensor assembly configured to detect a predetermined position of the detection lever, the sensor assembly including a sensor and an actuation member configured to engage the sensor when the actuation member is within a predetermined region relative to the sensor.

11. The ice maker according to claim 10, wherein the predetermined position of the detection lever corresponds to the extended position.

12. The ice maker according to claim 10, wherein the sensor is a Hall Effect switch and the actuation member is a magnetic body configured to engage the hall effect switch when the magnetic body is within the predetermined region.

13. The ice maker according to claim 10, wherein the sensor is fixed to the carriage and the actuation member is fixed to the detection lever such that the actuation member engages the sensor when the detection lever is in the extended position.

14. An ice maker comprising:

a carriage;

an ice mold defining a plurality of cavities that is movably coupled to the carriage such that the ice mold is movable relative to the carriage between a home position and a harvest position;

a detection lever movably coupled to the carriage such that the detection lever is movable between a retracted position and an extended position, the detection member being biased toward the extended position; and a retention mechanism configured to retain the detection lever in the retracted position when the ice mold is in the harvest position, wherein the retention mechanism is configured to retain the detection lever in the retracted position when the ice mold is in the home position, and release the detection lever when the ice mold is moved from the home position to the harvest position; and a self-contained control system including:

a controller, a temperature sensor fixed to the ice mold, and a wire coupled that electrically connects the temperature sensor to the controller, wherein the ice mold has a coupling element that rotatably couples the ice mold to the carriage, and the wire passes through a hole in the coupling element.

15. The ice maker according to claim 14, wherein the drive assembly includes a drive shaft operatively coupled to the coupling element of the ice mold, and the wire passes through a hole in the drive shaft.

16. And the ice maker according to claim 1, further comprising a water slide for delivering water to the ice mold when in the home position, the water slide having a plurality of side walls and a floor that define a channel for water, wherein the ice maker defines a primary plane along which the plurality of cavities commonly open when the ice mold is in the home position, and the channel has a passage that curves about a slide axis that is substantially perpendicular to the primary plane.

17. The ice maker according to claim 16, wherein the channel has:

an inlet, an outlet, an inlet passage that extends downstream from the inlet, an intermediate passage that downstream of the inlet passage, and an outlet passage downstream from the intermediate passage that terminates at the outlet, wherein the inlet passage and the intermediate passage interest with each other to form a T-shape, and the intermediate passage is arranged substantially perpendicular to the inlet passage.

18. The ice maker according to claim 1, further comprising a first mounting element and a second mounting element for mounting the ice maker to an appliance, wherein:

the ice maker defines a primary plane along which the plurality of cavities commonly open when the ice mold is in the home position, the first mounting element and second mounting element respectively define a first mounting axis and a second mounting axis that are substantially parallel to the primary plane, and the first mounting axis and second mounting axis extend along a common mounting plane that is oblique to the primary plane.

19. The ice maker according to claim 18, wherein the mounting plane forms an angle with the primary plane, the angle being between 1° and 50°.

20. The ice maker according to claim 18, wherein the first mounting element corresponds to a first aperture defined by the carriage and the second mounting element corresponds to a second aperture defined by the carriage, wherein the first aperture extends farther from the primary plane than the second aperture.

21. The ice maker according to claim 1, wherein the carriage includes one or more mounting elements for mounting the carriage to a wall of an appliance.

* * * * *